US006368016B1

(12) United States Patent
Smith et al.

(10) Patent No.: US 6,368,016 B1
(45) Date of Patent: Apr. 9, 2002

(54) CONCRETE FINISHING TROWEL HAVING AN ELECTRONICALLY ACTUATED STEERING ASSEMBLY

(75) Inventors: Peter J. Smith, Hartford; Hassan Karbassi, Hartland, both of WI (US)

(73) Assignee: Wacker Corporation, Menomone Falls, WI (US)

( * ) Notice: Subject to any disclaimer, the term of this patent is extended or adjusted under 35 U.S.C. 154(b) by 0 days.

(21) Appl. No.: 09/352,225

(22) Filed: Jul. 13, 1999

(51) Int. Cl.[7] ..... G01C 19/22
(52) U.S. Cl. ..... 404/112
(58) Field of Search ..... 404/112

(56) References Cited

U.S. PATENT DOCUMENTS

| | | | | | |
|---|---|---|---|---|---|
| 3,936,212 | A | * | 2/1976 | Holz, Sr. et al. | 404/112 |
| 4,046,483 | A | | 9/1977 | Sutherland | 404/112 |
| 4,046,484 | A | | 9/1977 | Holz, Sr. et al. | 404/112 |
| 5,108,220 | A | | 4/1992 | Allen et al. | 404/112 |
| 5,584,598 | A | * | 12/1996 | Watanabe et al. | 404/112 |
| 5,632,570 | A | | 5/1997 | Balling | 404/112 |
| 5,816,740 | A | * | 10/1998 | Jaszkowiak | 404/112 |
| 5,890,833 | A | | 4/1999 | Allen et al. | 404/112 |
| 5,899,631 | A | * | 5/1999 | Jaszkowiak | 404/112 |
| 5,988,938 | A | * | 11/1999 | Allen | 404/112 |
| 6,053,660 | A | * | 4/2000 | Allen et al. | 404/112 |
| 6,089,786 | A | * | 7/2000 | Allen et al. | 404/112 |

OTHER PUBLICATIONS

Whiteman, HTH–Series Ride–On Power Trowels, Hydrostatic Drive–Hydraulic Steering, (1/97) 4 page brochure.

Whiteman, Ride–On Power Trowels, (WIROTFUL–562 Rev. A, (03/97) 4 page brochure.

Allen Engineering Corporation, Super Pro Riding Trowels—400–1200–SHD–38KB–PSII, http://www.alleng.com pp. 1–4 (Jul. 5, 2001).

Allen Engineering Corporation, Super Pro Riding Trowels—450–1200–SHD–42NI–PSII, http://www.alleng.com pp. 1–4 (Jul. 5, 2001).

M–B–W, *Slipform Paver,* http://mbw.com, pp. 1–4 (Jul. 5, 2001).

* cited by examiner

*Primary Examiner*—Thomas B. Will
*Assistant Examiner*—Raymond Addie
(74) *Attorney, Agent, or Firm*—Boyle Frederickson Newholm Stein & Gratz S.C.

(57) ABSTRACT

A self-propelled concrete finishing trowel has a power steering control system that steers the machine by tilting the driven shaft(s) of the rotor assembly or assemblies of the machine without requiring the imposition of fatiguing actuating forces by the machine's operator. The steering control system includes at least one electric actuator, such as a ball screw actuator, coupled to each rotor assembly of the machine and controlled by an operator-manipulated controller. The controller preferably includes at least one, and possibly two, joysticks that can be manipulated by the operator to steer the machine in the direction of joystick motion and preferably at a speed that is proportional to the magnitude of joystick movement. In the typical case in which the machine is steered by pivoting a gearbox of at least one rotor assembly about two axes, a separate actuator is provided for each axis of gearbox pivoting. The resultant machine is easy to operate, lightweight, and exhibits little risk of high-pressure fluid spills.

44 Claims, 15 Drawing Sheets

CONCRETE FINISHING TROWEL HAVING AN ELECTRONICALLY ACTUATED STEERING ASSEMBLY

BACKGROUND OF THE INVENTION

1. Field of the Invention

The invention relates to concrete finishing trowels which employ one or more rotatable blade-equipped rotor assemblies for finishing a concrete surface. More particularly, the invention relates to a concrete finishing trowel, such as a riding trowel, having rotor assemblies that can be tilted for a steering operation.

2. Description of the Related Art

A variety of machines are available for smoothing or otherwise finishing wet concrete. These machines range from simple hand trowels, to walk-behind finishing trowels, to self-propelled finishing trowels including some larger walk-behind machines as well as relatively large two-rotor or even three-rotor machines. Self-propelled finishing trowels, and particularly riding finishing trowels, can finish large sections of concrete more rapidly and efficiently than manually pushed finishing trowels. The invention is directed to self-propelled finishing trowels and is described primarily in conjunction with riding finishing trowels by way of explanation.

Riding concrete finishing trowels typically include a mobile frame including a deck. At least two, and sometimes three or more, rotor assemblies are mounted on an underside of the deck. Each rotor assembly includes a driven shaft extending downwardly from the deck and a plurality of trowel blades mounted on and extending radially outwardly from the bottom end of the driven shaft and supported on the surface to be finished. The driven shafts of the rotor assemblies are driven by one or more self-contained engines mounted on the frame and typically linked to the driven shafts by gearboxes of the respective rotor assemblies. The weight of the finishing trowel and the operator is transmitted frictionally to the concrete by the rotating blades, thereby smoothing the concrete surface. The individual blades usually can be tilted relative to their supports, via operation of a suitable mechanical lever and linkage system accessible by an operator seated on an operator's platform to alter the pitch of the blades, and thereby to alter the pressure applied to the surface to be finished by the weight of the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

The blades of riding trowels can also be tilted, independently of pitch control for finishing purposes, for steering purposes. By tilting the driven shafts of the rotor assemblies, the operator can cause the forces imposed on the concrete surface by the rotating blades to propel the vehicle in a direction extending perpendicularly to the direction of driven shaft tilt. Specifically, tilting at least the driven shaft of the rotor assembly from side-to-side and fore-and-aft steers the vehicle in the forward/reverse and the left/right directions, respectively. It has been discovered that, in the case of a riding trowel having two rotor assemblies, the driven shafts of both rotor assemblies should be tilted for forward/reverse steering control, whereas only the driven shaft of one of the rotor assemblies needs to be tilted for left/right steering control.

The most common steering assemblies are mechanically operated. These assemblies typically include two steering control levers mounted adjacent the operator's seat and accessible by the operator's left and right hands, respectively. Each lever is mechanically coupled, via a suitable mechanical linkage assembly, to a pivoting gearbox of an associated rotor assembly. The operator steers the vehicle by tilting the levers fore-and-aft and side-to-side to tilt the gearboxes side-to-side and fore-and-aft, respectively. Steering assemblies of this type are disclosed, e.g., in U.S. Pat. No. 4,046,484 to Holz and U.S. Pat. No. 5,108,220 to Allen et al.

Mechanically operated steering control assemblies of the type disclosed in the Holz and Allen et al. patents are difficult to operate because they require the imposition of a significant physical force by the operator. The typical steering control lever requires 20–40 pounds of force to operate in either its fore-and-aft direction or its side-to-side direction. Most operators experience fatigue when exerting these forces, particularly when one considers that the operator must exert these forces continuously or nearly continuously for several hours at a time with little or no rest. Operator fatigue is particularly problematic with respect to side-to-side motions, which, due to the ergonomics of the machines, are considerably more difficult for operators to impose than fore-and-aft motions.

Proposals have been made to replace the traditional mechanically operated steering control assemblies of a concrete finishing machine with power-actuated assemblies. For instance, Whiteman Industries, Inc., of Carson, California has introduced a hydraulically steered riding trowel under its tradename "HTS-Series." This machine is hydrostatically driven via hydrostatic pumps which are powered by the machine's engine and which supply pressurized hydraulic fluid both to hydraulic motors of the rotor assemblies, and to hydraulic steering cylinders which tilt the driven shafts of the rotor assemblies. The steering assemblies are controlled by joysticks mounted on the operator's platform adjacent the operator's seat. These joysticks are easier to operate than traditional mechanical levers. The operator therefore does not experience the fatigue experienced by operators of traditional, mechanically steered machines.

A hydrostatically steered concrete finishing trowel, though superior in some respects to a mechanically steered machine, exhibits its own drawbacks and disadvantages. For instance, the hydrostatic pump, hydraulic motor, steering cylinders, and associated hydraulic devices render the machine very heavy. Accordingly, even with the blades set at their minimum pitch so as to distribute the machine's weight over a maximum area, the operator must let the concrete set longer than otherwise would be necessary before he or she can perform the initial, so-called "floating" finishing operation. This delay hinders a finishing operation because it leaves the operator with less time to finish the concrete. In addition, the complex hydraulic system required by hydrostatically steered machines is prone to leaks. Oil spills on fresh concrete are, of course, undesirable. Finally, hydrostatically steered machines are considerably more expensive than manually-steered machines due to the relatively large and expensive hydraulic motors, valves, etc.

A need therefore has arisen to provide a self-propelled finishing trowel having a steering control assembly that can be operated automatically and that is relatively lightweight, inexpensive, and reliable when compared to mechanically steered machines and hydrostatically steered machines.

OBJECTS AND SUMMARY OF THE INVENTION

It is therefore a first principal object of the present invention to provide a self-propelled finishing trowel that incorporates a power-actuated steering system that is relatively simple, lightweight, and inexpensive.

Another object of the invention is to provide a self-propelled concrete finishing trowel that meets the first principal object and that substantially eliminates or at least significantly reduces operator fatigue.

Yet another object of the invention is to provide a concrete finishing trowel that meets the first principal object and that does not require high pressure fluids for its operation and, hence, exhibits reduced possibility of hydraulic fluid spills when compared to systems requiring high pressure fluids for their operation.

A second principal object of the invention is to provide an improved method of steering a self-propelled concrete finishing trowel that requires the imposition of only small actuating force by the operator and, accordingly, is not fatiguing to the operator.

Another object of the invention is to provide a method that meets the second principal object and that does not utilize heavy, complex, and leak-prone hydraulic systems.

In accordance with a first aspect of the invention, these objects are achieved by steering a concrete finishing trowel not with a mechanical lever system or a hydraulic system, but with electronic actuators such as ball screw actuators. The actuators are controlled indirectly by way of a controller such as an electronic joystick and, when energized, tilt at least the driven shaft(s) of the machine's rotor assembly or rotor assemblies to effect the desired steering operation.

Preferably, the actuator or actuators of the actuator arrangement associated with each rotor assembly is/are connected to that rotor assembly by a relatively simple steering linkage connected directly to the rotor assembly's gearbox. In the typical case of a riding trowel having two rotor assemblies, two actuators and a biaxially pivoting steering linkage will be supplied for one of the rotor assemblies to effect both left/right and forward/reverse steering control, whereas only a single actuator and its associated uniaxially pivoting steering linkage will be provided for the other rotor assembly so as to effect only forward/reverse steering control.

The controller may comprise any structure converting physical movement of the operator into an electronic steering command signal. For instance, it may comprise one or more joysticks, preferably a proportional control joystick, that is electronically coupled to the actuators. The joystick(s) is/are coupled to the actuators such that, as the actuators move, a feedback circuit compares the joystick position with the actuator position and continues actuator energization until the actuator position matches the commanded position as determined by the joystick position. If the joystick is released, the actuator returns automatically to its centered position. Due to the nature of the feedback circuit between the joystick and the respective actuator, the travel speed of the machine over the surface to be finished is directly proportional to the magnitude of joystick movement, and the machine moves in the direction of the joystick movement. Because the operator input forces are very small, operator fatigue is significantly reduced during operation of the invention when compared to operation of traditional, mechanically steered machines.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a self-propelled concrete finishing trowel is provided having an improved power steering control system that steers the machine by tilting the driven shaft(s) of the rotor assembly or assemblies of the machine without requiring the imposition of fatiguing actuating forces by the machine's operator. The steering control system includes at least one electric actuator, such as a ball screw actuator, coupled to each rotor assembly of the machine and controlled by an operator-manipulated controller. The controller preferably includes at least one, and possibly two, joysticks that can be manipulated by the operator to steer the machine in the direction of joystick motion and preferably at a speed that is proportional to the magnitude of joystick movement. In the typical case in which the machine is steered by pivoting a gearbox of at least one rotor assembly about two axes, a separate actuator is provided for each axis of gearbox pivoting. The resultant machine is easy to operate, lightweight, and exhibits little risk of high-pressure fluid spills.

2. System Overview

The present invention is applicable to any power concrete finishing trowel that is steered by tilting of the rotor assembly or rotor assemblies of the trowel. Hence, while the invention is described herein primarily in conjunction with a riding finishing trowel having two counter-rotating rotor assemblies, it is not so limited.

Figure 1:
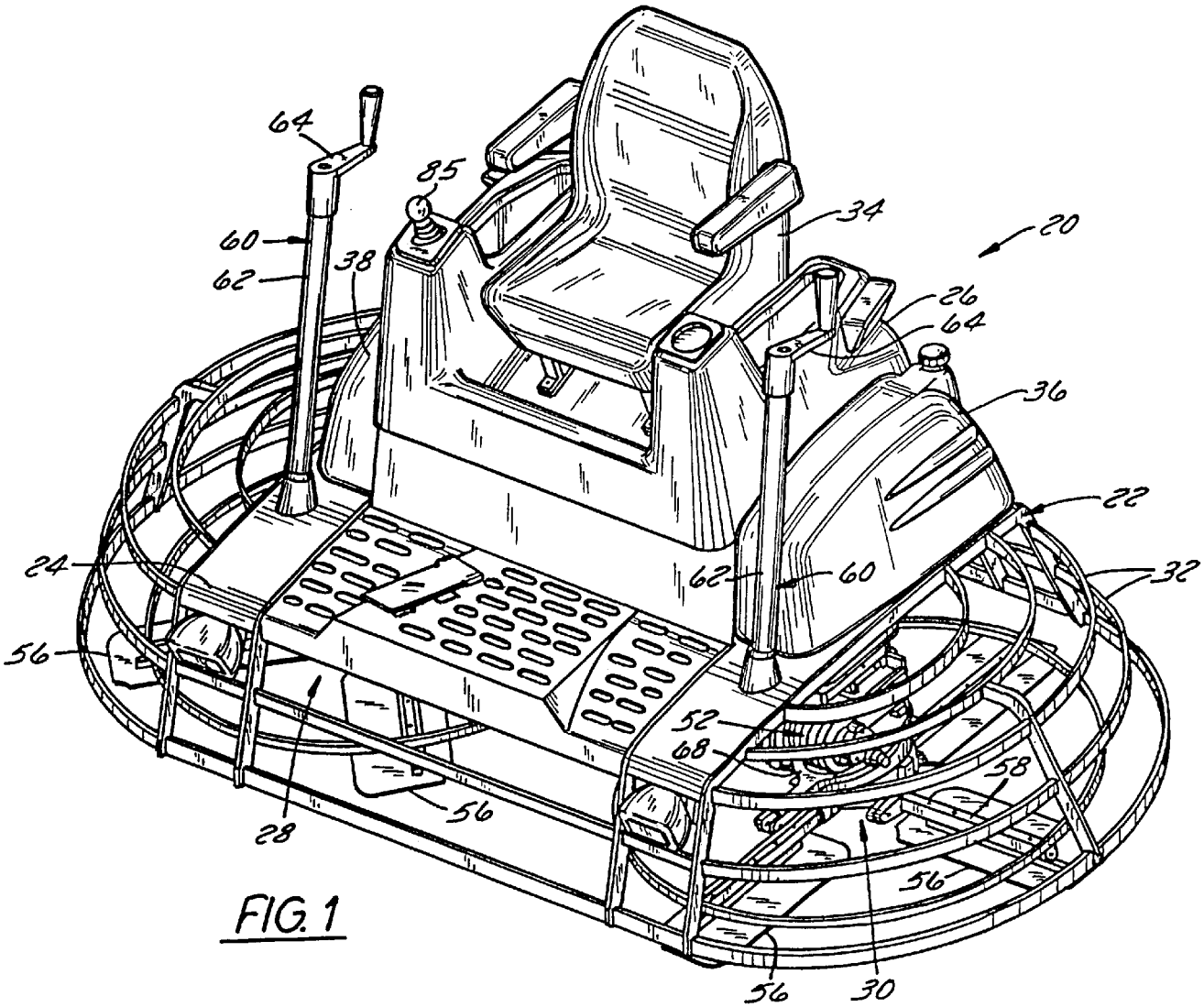
FIG. 1 is a perspective view of a riding concrete finishing trowel constructed in accordance with a preferred embodiment of the invention.

Referring now to FIGS. 1–6 and initially to FIG. 1 in particular, a riding concrete finishing trowel 20 in accordance with a preferred embodiment of the invention includes as its major components a rigid metallic frame 22, an upper deck 24 mounted on the frame, an operator's platform or pedestal 26 provided on the deck, and right and left rotor assemblies 28 and 30, respectively, extending downwardly from the deck 24 and supporting the finishing machine 20 on the surface to be finished. The rotor assemblies 28 and 30 rotate towards the operator, or counterclockwise and clockwise, respectively, to perform a finishing operation. A conventional ring guard 32 is positioned at the outer perimeter of the machine 20 and extends downwardly from the deck 24 to the vicinity of the surface to be finished. The pedestal 26 is positioned longitudinally centrally on the deck 24 at a rear portion thereof and supports an operator's seat 34. The pedestal 26 and seat 34 can be pivoted via hinges (not shown) to permit access to components of the machine located thereunder, such as the machine's engine 72. A fuel tank 36 is disposed adjacent the left side of the pedestal 26, and a water retardant tank 38 see FIG. 1 is disposed on the right side of the pedestal 26 and overlies one of the actuators 86 of a steering system 76 detailed below.

Figure 2:
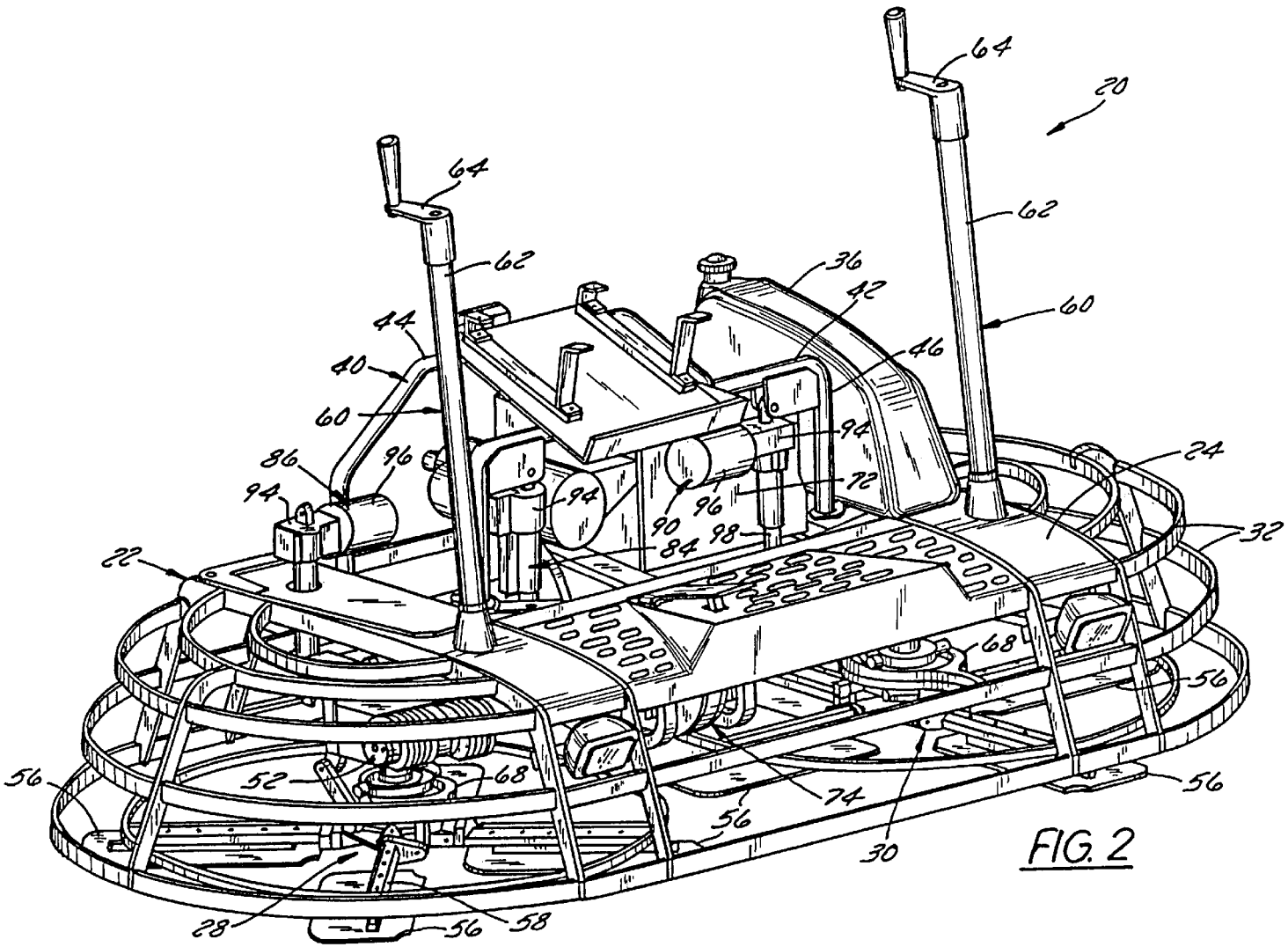
FIG. 2 corresponds to FIG. 1 and illustrates the finishing trowel with the operator's seat and adjacent shrouds removed.
Figure 5:
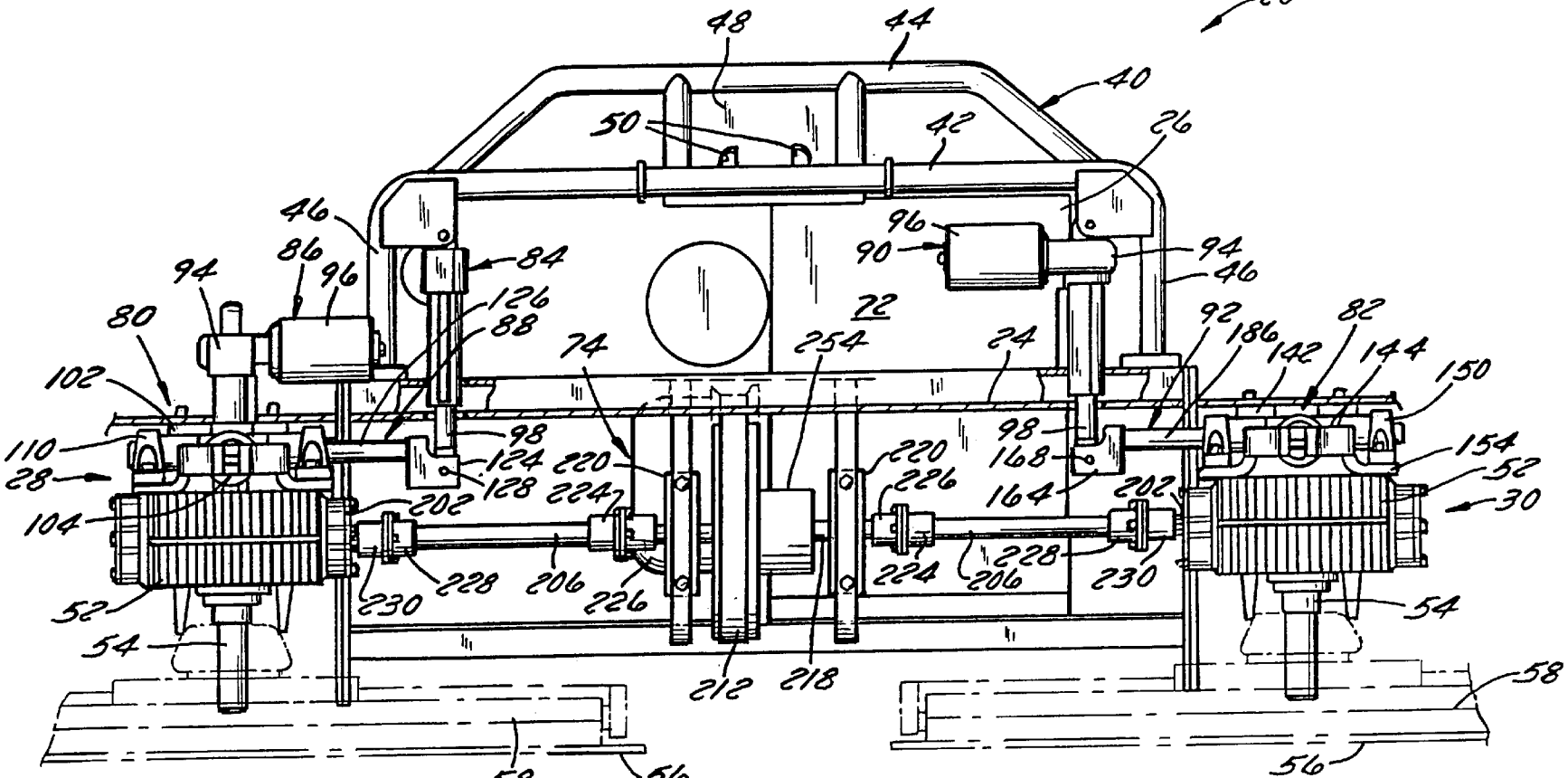
FIG. 5 is a partially fragmentary, partially schematic sectional end elevation view of the finishing trowel.
Figure 6:
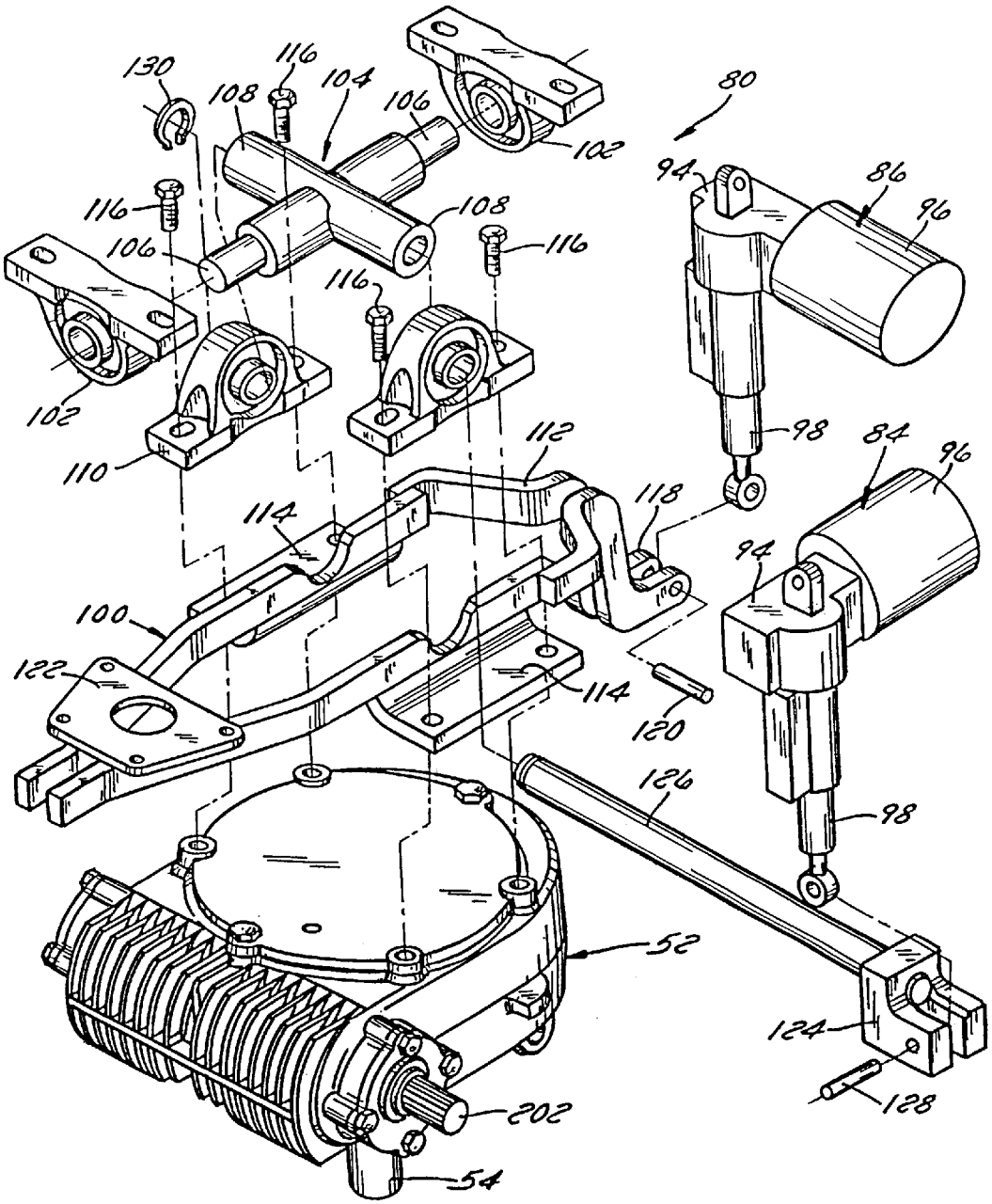
FIG. 6 is a partially exploded, perspective view of the right rotor assembly of the finishing trowel, along with the associated steering linkage and actuators.
Figure 8:
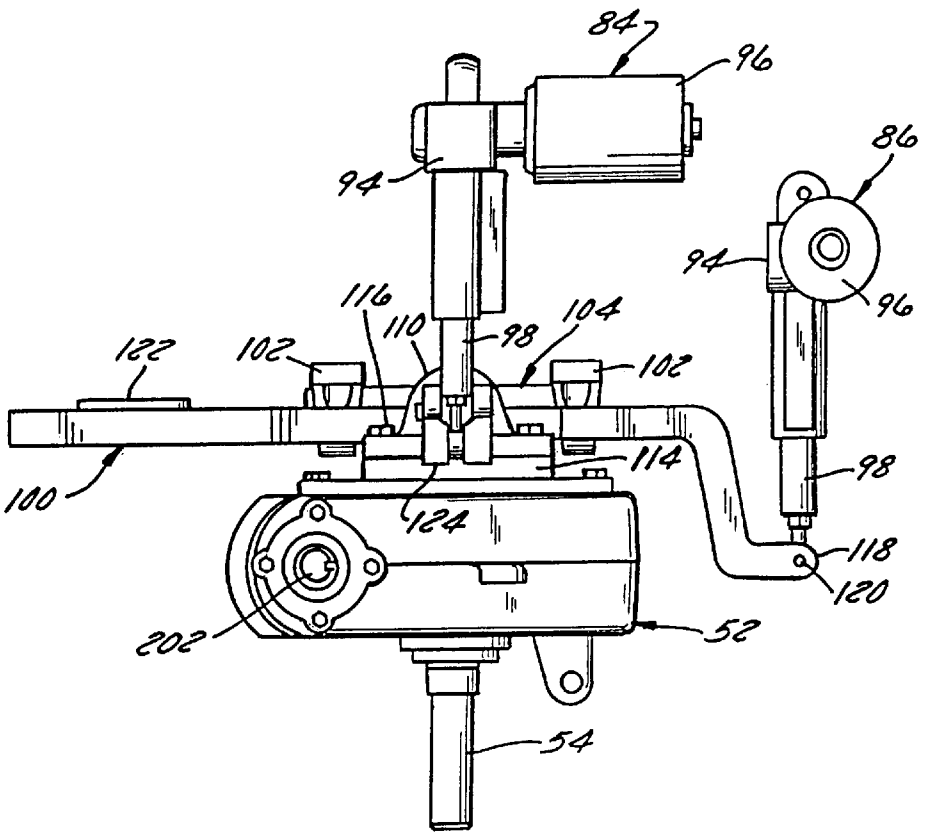
FIG. 8 is a side elevation view of the assembly of FIGS. 6 and 7.
Figure 7:
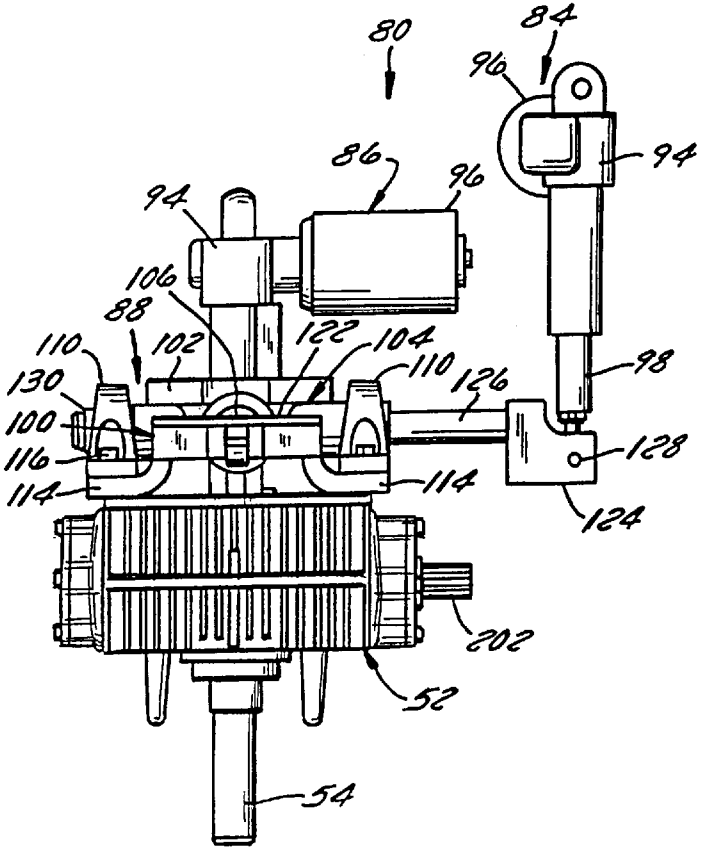
FIG. 7 is a front elevation view of the assembly of FIG. 6.
Figure 9:
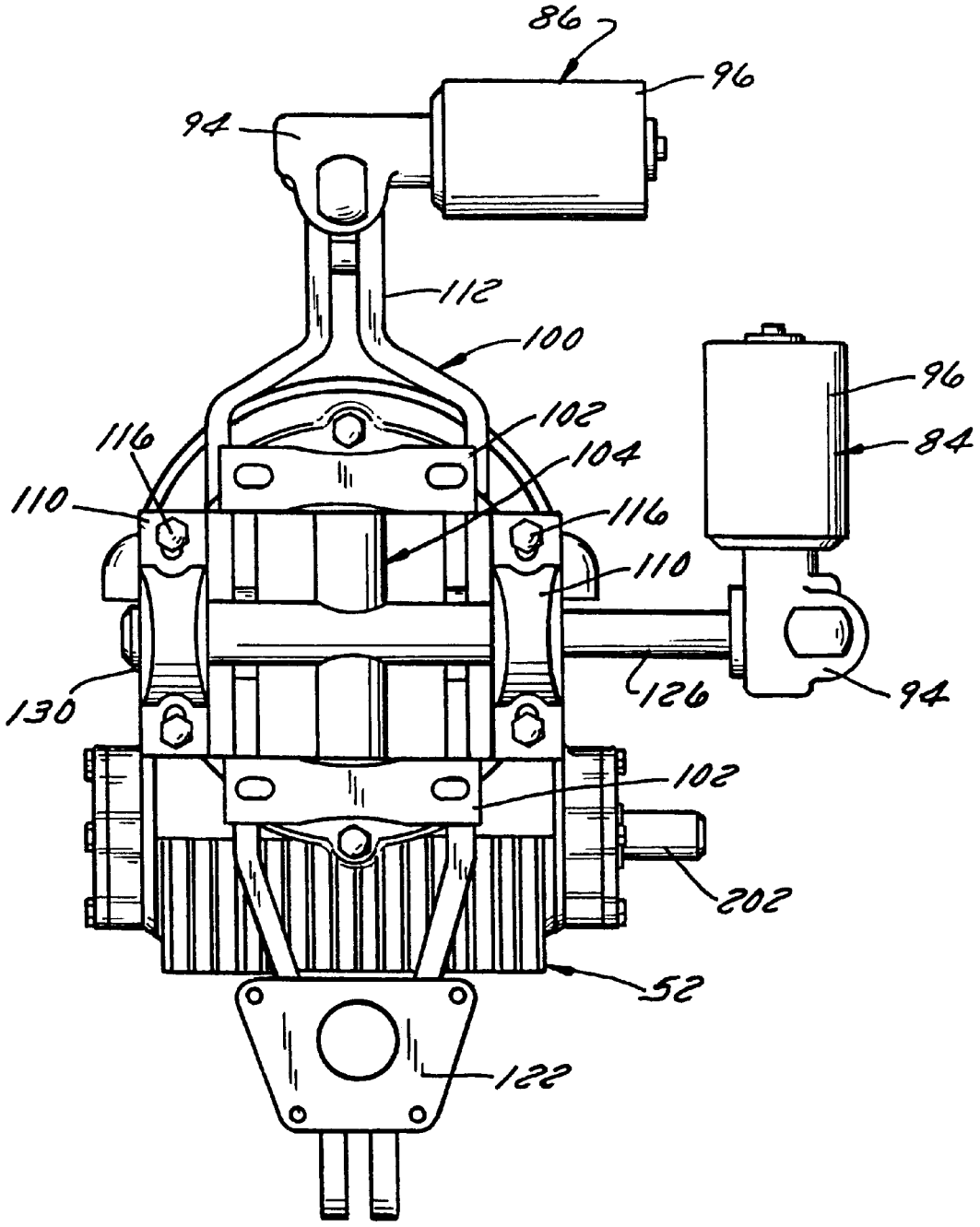
FIG. 9 is a top plan view of the assembly of FIGS. 6–8.
Figure 10:
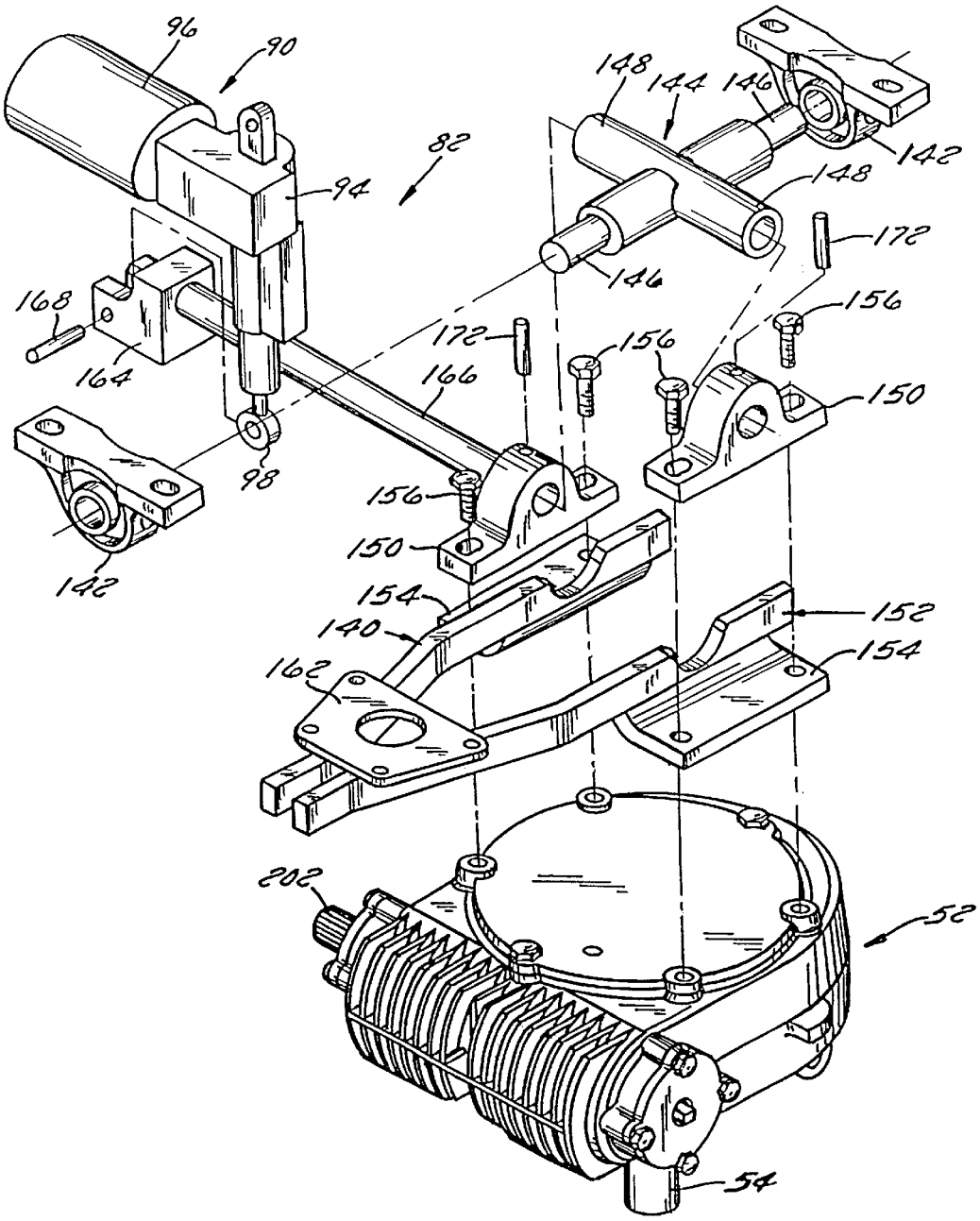
FIG. 10 a partially exploded perspective view of the left rotor assembly of the machine, along with the associated steering linkage and actuator.
Figure 11:
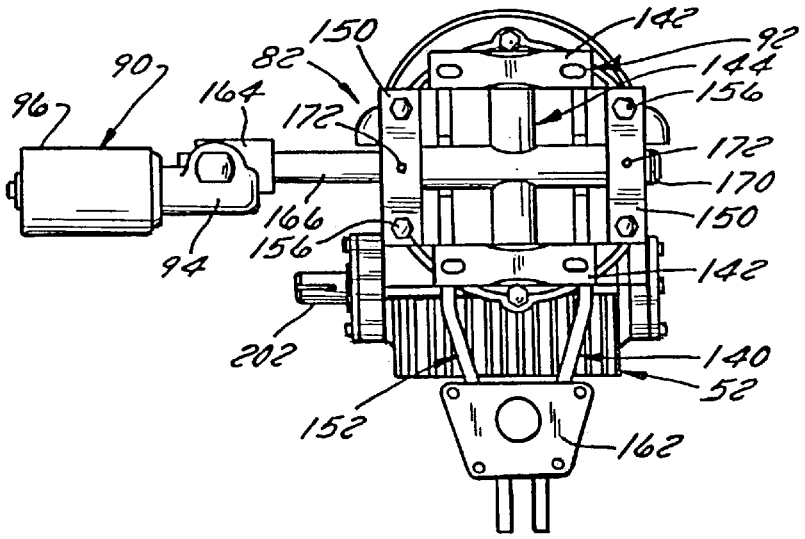
FIG. 11 is a top plan view of the assembly of FIG. 10.
Figure 12:
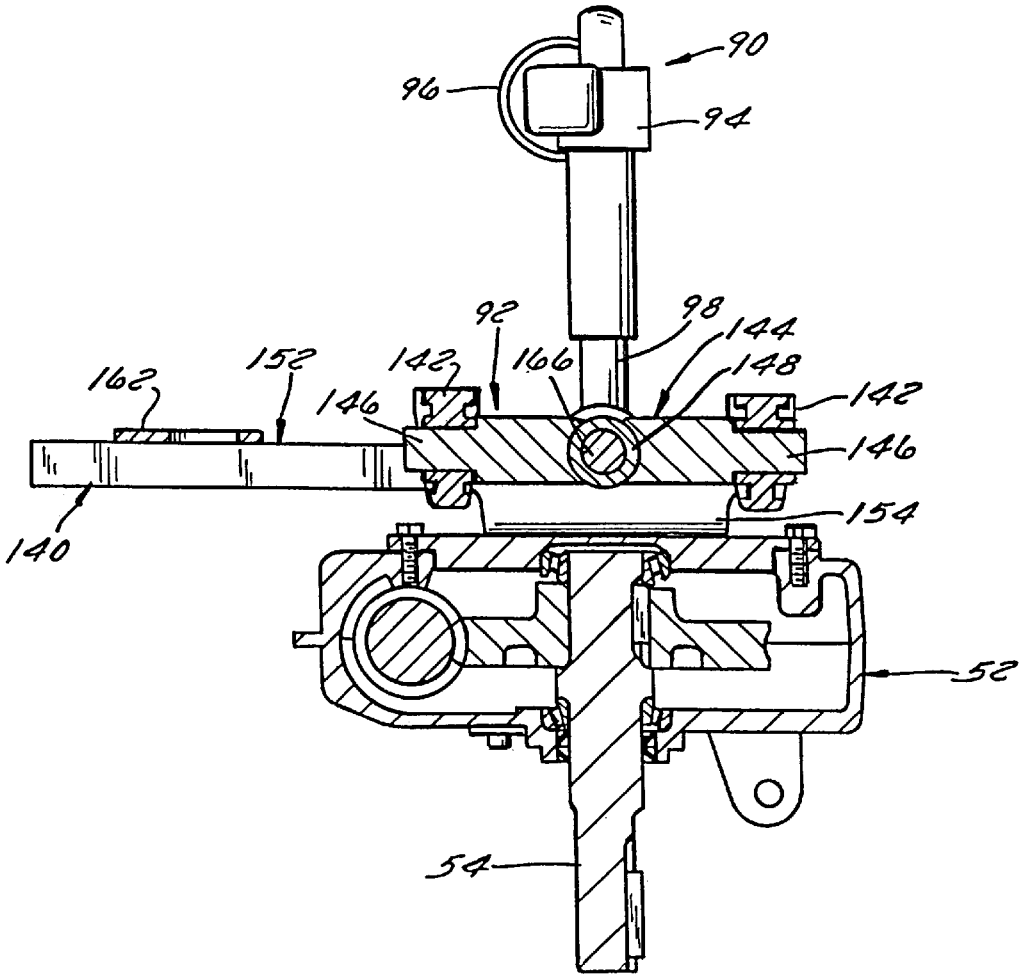
FIG. 12 is a sectional side elevation view of the assembly of FIGS. 10 and 11.

A lift cage assembly 40, best seen in FIGS. 2 and 5, is attached to the upper surface of the deck 24 beneath the pedestal 26 and seat 34. The lift cage assembly 40 is formed from a plurality of interconnected steel tubes including front and rear generally horizontal tubes 42 and 44 spaced above the deck 24 by vertical support tubes 46 positioned at the ends of the generally horizontal tubes 42 and 44. The front and rear generally horizontal tubes 42 and 44 are connected to one another by a plate 48 that has D-shaped cutouts 50 (FIG. 5) to provide a central lifting location for receiving a hook or the like. The cutouts 50 are positioned such that the entire machine 20 can be lifted from a central lift point, thereby eliminating the need for a harness or a four-point type attachment usually used to lift machines of this type for transport.

Figure 3:
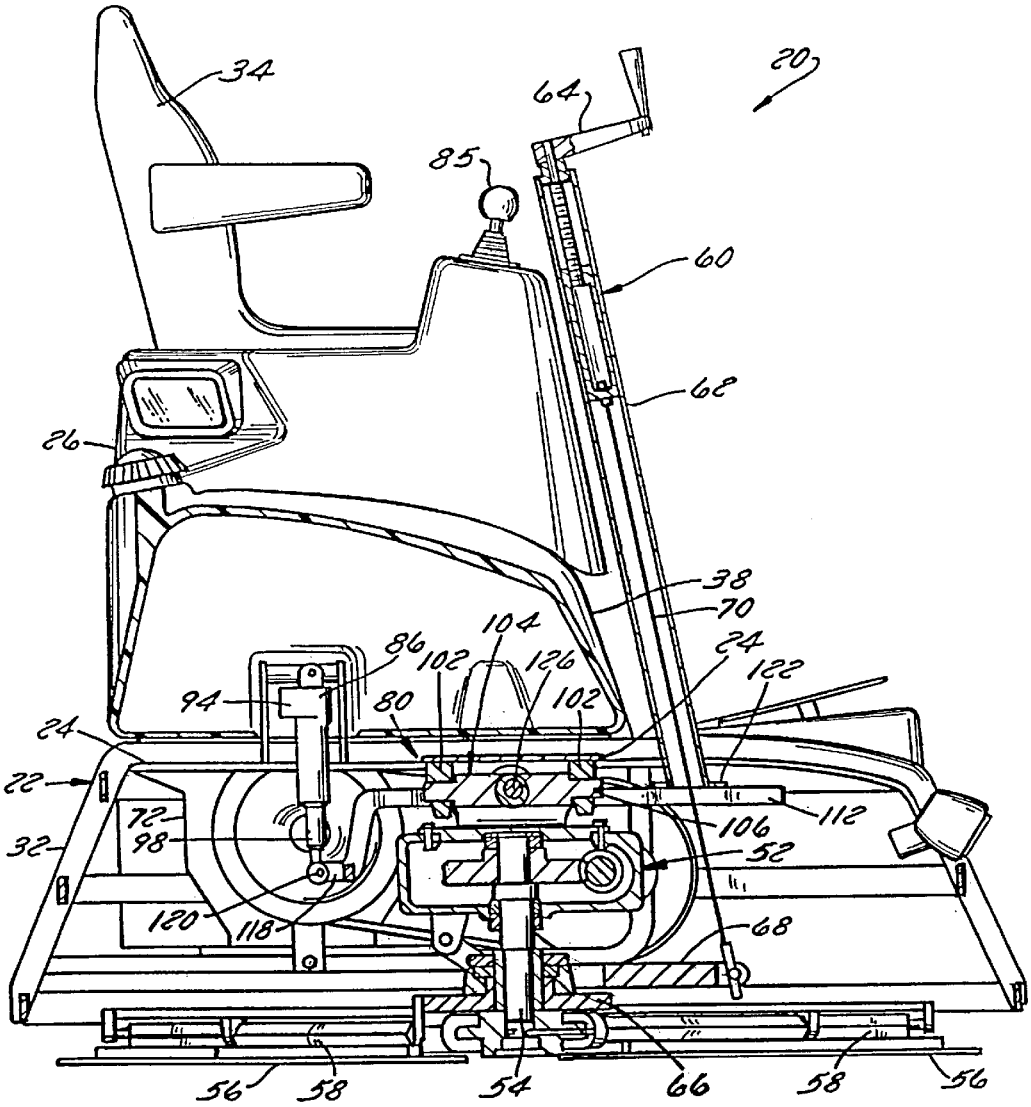
FIG. 3 is a right side sectional elevation view of the finishing trowel, taken through the right rotor assembly of the machine.
Figure 4:
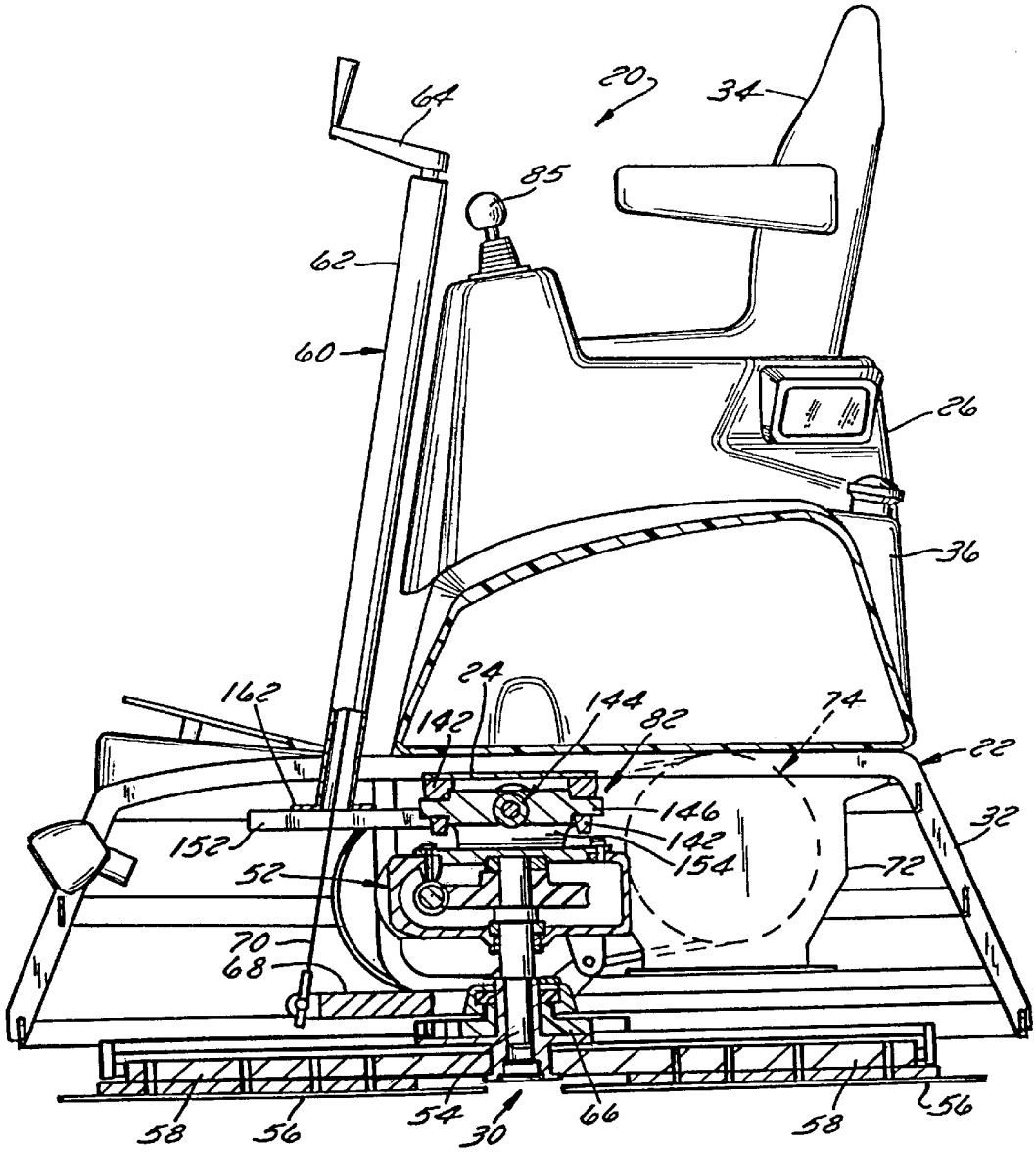
FIG. 4 is a left side sectional elevation view of the finishing trowel, taken through the left rotor assembly of the machine.

Referring now to FIGS. 3–5, each rotor assembly 28, 30 includes a gearbox 52, a driven shaft 54 extending downwardly from the gearbox, and a plurality of circumferentially-spaced blades 56 supported on the driven shaft 54 via radial support arms 58 and extending radially outwardly from the bottom end of the driven shaft 54 so as to rest on the concrete surface. Each gearbox 52 is mounted on the undersurface of the deck 24 so as to be tiltable about the deck 24 for reasons detailed below.

The pitch of the blades 56 of each of the right and left rotor assemblies 28 and 30 can be individually adjusted by a dedicated blade pitch adjustment assembly, generally designated 60 in FIGS. 1–4. Each blade pitch adjustment assembly 60 includes a generally vertical post 62 and a crank 64 which is mounted on top of the post 62, and which can be rotated by the operator to vary the pitch of the trowel blades 56. In the typical arrangement, a thrust collar 66 cooperates with a yoke 68 that is movable to force the thrust collar 66 into a position pivoting the trowel blades 56 about an axis extending perpendicular to the axis of the driven shaft 54. A tension cable 70 extends from the crank 64, through the post 62, and to the yoke 68 to interconnect the yoke 68 with the crank 64. Rotation of the crank 64 adjusts the yoke's angle to move the thrust collar 66 up or down thereby providing a desired degree of trowel blade pitch adjustment. A power concrete finishing trowel having this type of blade pitch adjustment assembly is disclosed, e.g., in U.S. Pat. No. 2,887,934 to Whiteman, the disclosure of which is hereby incorporated by reference.

Both rotor assemblies 28 and 30, as well as other powered components of the finishing trowel 20, are driven by a power source such as a gasoline powered internal combustion engine 72 mounted under the operator's seat 34. The size of the engine 72 will vary with the size of the machine 20 and the number of rotor assemblies powered by the engine. The illustrated two-rotor, rotor 48" machine typically will employ an engine of about 25 hp. The rotor assemblies 28 and 30 are connected to the engine 72 via a unique torque transfer system 74 (FIGS. 15–17) and can be tilted for steering purposes via a unique steering system 76 (FIGS. 6–14). The steering system 76 and torque transfer system 74 will now be described in turn.

3. Steering System

As is typical of riding concrete finishing trowels of this type, the machine 20 is steered by tilting a portion or all of each of the rotor assemblies 28 and 30 so that the rotation of the blades 56 generates horizontal forces that propel the machine 20. The steering direction is perpendicular to the direction of rotor assembly tilt. Hence, side-to-side and fore-and-aft rotor assembly tilting cause the machine 20 to move forward/reverse and left/right, respectively. The most expeditious way to effect the tilting required for steering control is by tilting the entire rotor assemblies 28 and 30, including the gearboxes 52. The discussion that follows therefore will describe a preferred embodiment in which the entire gearboxes 52 tilt, it being understood that the invention is equally applicable to systems in which other components of the rotor assemblies 28 and 30 are also tilted for steering control.

More specifically, the machine 20 is steered to move forward by tilting the gearboxes 52 laterally to increase the pressure on the inner blades of each rotor assembly 28, 30 and is steered to move backwards by tilting the gearboxes 52 laterally to increase the pressure on the outer blades of each rotor assembly 28, 30. Side-to-side steering requires tilting of only one gearbox (the gearbox 52 of the right rotor assembly 28 in the illustrated embodiment), with forward tilting of the gearbox 52 increasing the pressure on the front blades of the rotor assembly 28 to steer the machine 20 to the right. Similarly, rearward tilting of the gearbox 52 increases the pressure on the back blades of the rotor assembly 28 to steer the machine 20 to the left.

The steering system 76 tilts the gearboxes 52 of the right and left rotor assemblies 28 and 30 using right and left steering assemblies 80 and 82 controlled by a controller 85. The right steering assembly 80, best seen in FIGS. 5–9 includes a first or right actuator arrangement and a first or right steering linkage 88 coupling the right actuator arrangement to the gearbox 52 of the right rotor assembly 28. Similarly, the left steering assembly 82, best seen in FIGS. 10–12, includes a second or left actuator arrangement and a second or left steering linkage 92 coupling the second actuator arrangement to the gearbox 52 of the left rotor assembly 30. The first actuator arrangement includes both a forward/reverse actuator 84 and a left/right actuator 86, whereas the second actuator arrangement includes only a forward/reverse actuator 90. The controller 85 preferably is coupled the actuators 84, 86, and 90 so that manipulation of the controller 85 in a particular direction steers the machine 20 to move in that same direction, preferably at a speed that is proportional to the magnitude of controller movement.

The actuators 84, 86, and 90 extend vertically through the deck 24 of the concrete finishing trowel 20 and are attached directly or indirectly to the frame 22, e.g., by attachment to the deck 24 and/or to the lift cage assembly 40 as best seen in FIGS. 2–5. Each actuator may comprise any electrically-operated device that selectively receives energizing current from the controller 85 in the form of electrical steering command signals and translates those command signals into linear movement of the output of the actuator and resultant pivoting of the associating steering linkage 88 or 92. The actuators 84, 86 and 90 preferably are of the type that have internal feedback potentiometers which compare the actual position of the actuator's output with the commanded position transmitted by the controller 85. When those positions match, actuator motion stops, and the actuator holds its output in that position. Suitable actuators comprise ball-screw actuators available, e.g., from Warner Electric of South Beloit, Ill. These actuators are bi-directional, versatile, relatively low-cost, and feedback controlled. Each actuator 84, 86, or 90 includes 1) a stationary base 94 extending above the deck 24 and fixed to the deck or another stationary component of the machine 20, 2) an electric motor 96, and 3) a linearly-displaceable rod 98. The rod 98 is driven by a ball screw drive, which provides precise positioning and high load carrying capacity. For instance, an actuator of this type can provide saddle speeds up to 49" per second and drive axial loads up to 900 lbs. The preferred actuator has a force rating of approximately 500 lbs., though lighter-duty actuators could be used if the steering linkages 88 and 92 were to be replaced by more complex lever assemblies. It should be emphasized, however, that ball-screw actuators of this type are not essential to the invention and that other electrically-powered actuators could be used in their stead.

Each of the left and right steering linkages 88 and 92 will now be described in turn.

Referring to FIGS. 3 and 5–9, the right steering linkage 88 includes a steering bracket 100 and a pivoting support assembly mounting the steering bracket 100 on the deck 24 for biaxial pivoting movement with respect thereto. The pivoting support assembly includes first and second pairs of pillow block bearings 102 and 110, and a cross tube 104. The first pair of pillow block bearings 102 is bolted to the bottom of the deck 24. The cross tube 104 has 1) opposed longitudinal ends 106 journaled in the pillow block bearings 102 and 2) opposed lateral ends 108 disposed adjacent the second pair of pillow block bearings 110. The steering bracket 100 includes a frame 112 extending longitudinally of the machine 20 and a pair of mounting plates 114 extending laterally from the frame 112. The steering bracket 100 and gearbox 52 are fixed to the second pair of pillow block bearings 110 by bolts 116 extending through holes in the pillow block bearings 110, through mating holes in the mounting plates 114, and into tapped bores in the top of the gearbox 52. By this arrangement, the steering bracket 100 (and, hence, the gearbox 52) 1) pivots about a lateral axis of the cross tube 104 to effect fore-and-aft tilting of the gearbox and, accordingly, left/right steering and 2) pivots about a longitudinal axis of the cross tube 104 to effect side-to-side gearbox tilting and, accordingly, forward/reverse steering control. To enable gearbox pivoting about the cross tube's longitudinal axis, a longitudinal end of the frame 112 of the steering bracket terminates in a clevis 118 which is coupled to the output of the left/right actuator 86 by a pivot pin 120. In the illustrated embodiment, the opposite end of the frame 112 presents a mounting plate 122 for the blade pitch adjustment post 62 (see FIG. 3), thereby assuring that the blade pitch adjustment assembly 60 moves with the gearbox 52 and that a steering control operation therefore does not affect blade pitch. To enable gearbox pivoting about the cross tube's lateral axis, the output of the forward/reverse actuator 84 is pivotably connected to a clevis 124 of a pivot lever 126 via a pivot pin 128. The lever 126 extends through the second pair of pillow block bearings 110, through the lateral ends of the cross tube 104, and is held in place by a retaining ring 130.

Turning now to FIGS. 2, 4, 5 and 10–12, the left steering assembly 82 differs from the right steering assembly 80 only in that it is configured to pivot only side-to-side for forward/reverse steering operation. As a result, the clevis at the longitudinal end of its steering linkage 92 can be eliminated, along with the left/right actuator 86. In addition, the second set of bearings 110 can be replaced with simple supports 150. The left steering linkage 92 is otherwise identical to the right steering linkage and includes a steering bracket 140 and pivoting support assembly. The pivoting support assembly includes 1) pillow block bearings 142 and 2) a cross tube 144 having longitudinal ends 146 and lateral ends 148. The steering bracket 140 includes a frame 152 and a pair of mounting plates 154 extending laterally from the frame 152 and connected to the supports 150 and the gearbox 52 via bolts 156. The post 62 of the associated blade pitch adjustment assembly 60 is mounted on a mounting plate 162 mounted on one end of the frame 152. The output of the forward/reverse actuator 90 is coupled to a clevis 164 of pivot lever 166 by a pivot pin 168. The pivot lever 166 extends through the supports 150, through the lateral ends 148 of the cross tube 144, and is fixed to the supports 150 by spring pins 172 so that the gearbox 52 and frame 22 can pivot laterally about the longitudinal axis of the cross tube 144 but are fixed from longitudinal pivoting about the lateral axis.

Figure 13:
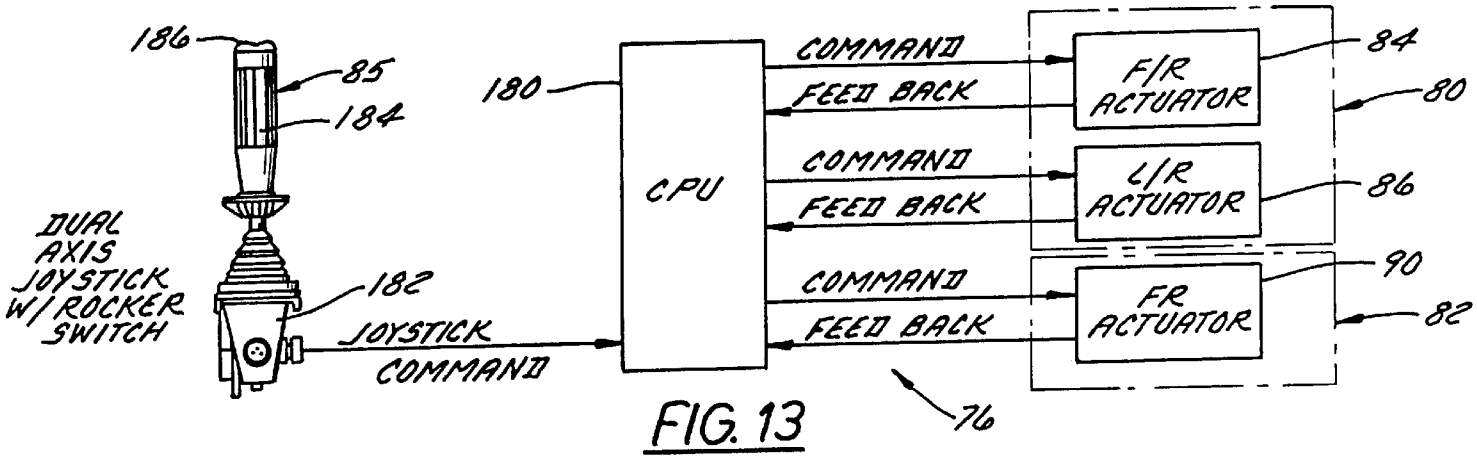
FIG. 13 is a schematic illustration of the electronic control components of a steering control system constructed in accordance with a first preferred embodiment of the invention.

The controller can be any device translating physical operator movements into electronic steering command signals. Turning now to FIG. 13, one preferred controller 85 for generating steering command signals and transmitting the steering command signals to the actuators 84, 86, and 90 is a dual-axis, proportional control joystick that is electronically coupled to the actuators via a programmed CPU 180. The above-mentioned feedback capability of the actuators 84, 86, and 90 permits them to interface with the CPU 180 to correlate actuator motion with joystick motion. As a result, the appropriate actuator 84, 86, or 90 moves in the direction commanded by the joystick 85 through a stroke that is proportional to the magnitude of joystick movement. The machine 20 therefore moves in the direction of joystick movement at a speed that is proportional to the magnitude of joystick movement. For instance, to steer the concrete finishing machine 20 to move forwardly, the joystick 85 is pivoted forwardly about its fore-and-aft axis, and the CPU 180 controls both forward/reverse actuators 84 and 90 to extend or retract their output rods through a stroke that is proportional to the degree of joystick movement, hence driving the gearboxes 52 to pivot laterally toward or away from each other by an amount that causes the machine 20 to move straight forward or rearward at a speed that is proportional to the magnitude of joystick movement. Similarly, joystick movement from side-to-side about its second axis generates a steering command signal that is processed by the CPU 180, in conjunction with the feedback potentiometers on the left/right actuator 86, to extend or retract the output rod of that actuator 86 so as to tilt the associated gearbox 52 forwardly or rearwardly by an amount that is proportional to the magnitude of joystick movement and that results in finishing machine movement to the right or left at a speed that is proportional to the magnitude of joystick movement. If the joystick 85 is released and, accordingly, returns to its centered or neutral position under internal biasing springs (not shown), each of the actuators 84, 86, and 90 also returns to its centered or neutral position.

Still referring to FIG. 13, the joystick 85 includes a stationary base 182 and a grip 184 that is mounted on the base 182 and that is pivotable as described above. A rocker switch 186 is mounted on the grip 184 and is operable when depressed to energize both forward/reverse actuators 84 and 90 simultaneously (but in opposite directions) so as to effect either clockwise or counterclockwise turning of the machine 20, depending upon the direction of rocker switch displacement. Preferably, the rocker switch 186 is configured such that the machine 20 turns clockwise when the rocker switch 186 is pivoted to the right and counterclockwise when the rocker switch 186 is pivoted to the left.

Figure 14:
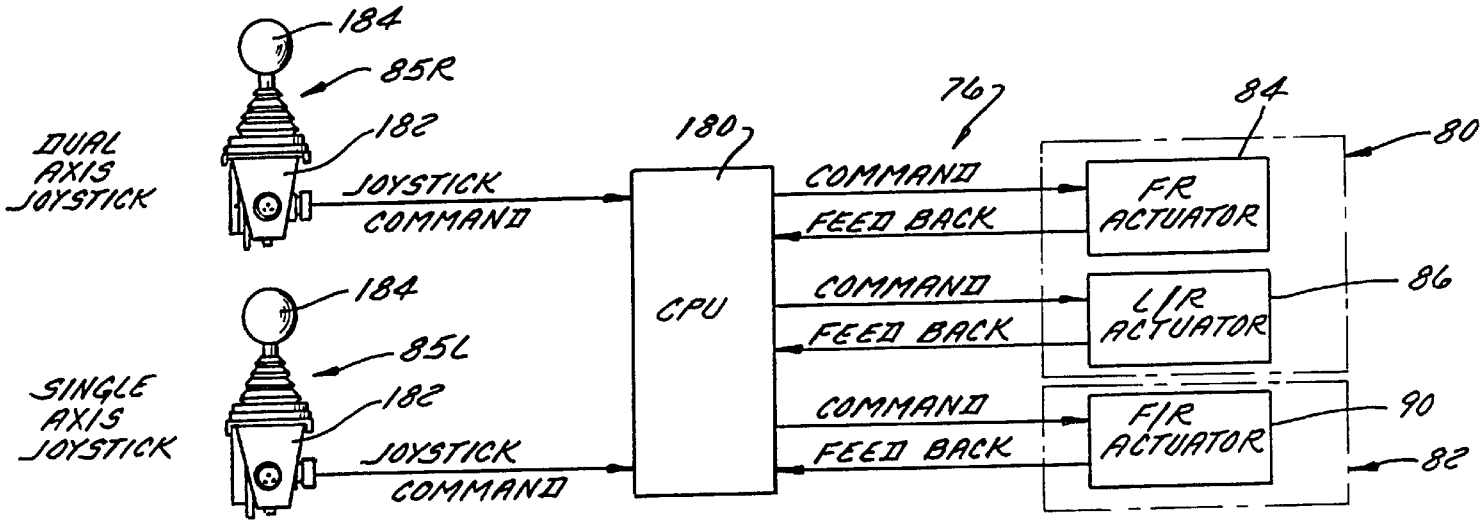
FIG. 14 is a schematic illustration of the electronic control components of a steering control system constructed in accordance with a second preferred embodiment of the invention.
Figure 15:
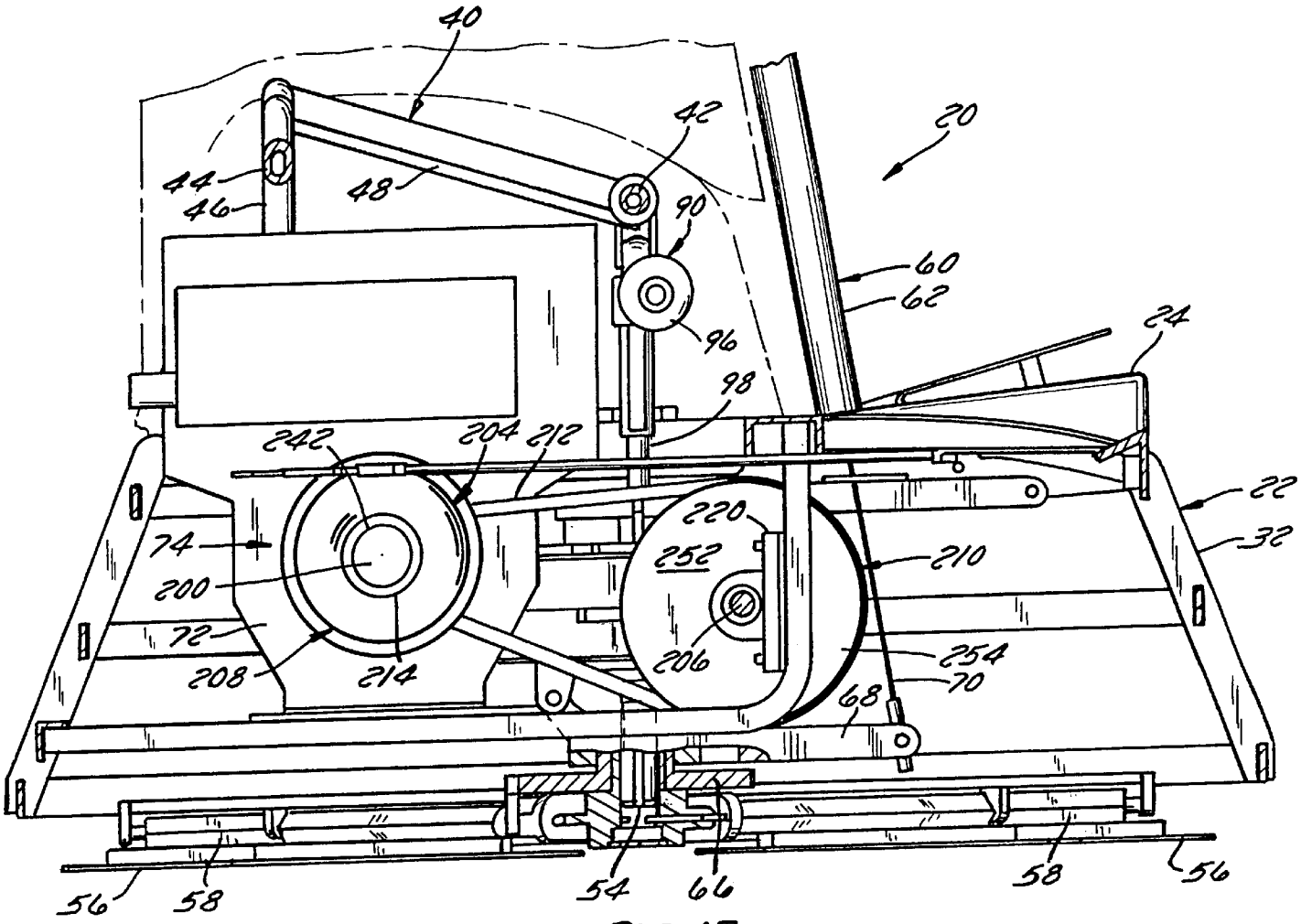
FIG. 15 is a sectional side elevation view of the finishing trowel, illustrating a torque transfer system of the machine.

As an alternative to the above-described arrangement, the single dual-axis joystick 85 of FIG. 13 can be replaced with two joysticks 85R and 85L as illustrated in FIG. 14, one of which (85R) is a dual-axis joystick suitable for both forward/reverse and left/right steering control and the other of which (85L) is a single-axis joystick which is pivotable only fore-and-aft to effect only forward/reverse steering control. The rocker switch is eliminated from this embodiment. Some operators might prefer this arrangement because it, like the conventional mechanical lever arrangements with which they are acquainted, uses a dedicated controller for each rotor assembly.

The above-described power steering system 76 exhibits many advantages over traditional mechanically operated systems and even over hydrostatically operated systems. For instance, it is much easier to operate than mechanically-operated systems, with the only forces required of the operator being the relatively small forces (on the order of less than 1–2 lbs) needed to overcome the internal spring forces of the joystick(s). In addition, much simpler mechanical linkages are required to couple the actuators 84, 86, and 90 to the gearboxes 52 than are required to couple mechanically-operated control levers to the gearboxes of earlier systems. Moreover, unlike hydrostatically steered systems, the machine 20 is relatively lightweight and does not risk high-pressure fluid spills.

4. Torque Transfer System

Referring now to FIGS. 15–18, the torque transfer system 74 is designed to transfer drive torque from an output shaft 200 of the engine 72 to the input shafts 202 of the gearboxes 52 so as to drive the rotor assemblies 28 and 30 to rotate. Significant novel features of the torque transfer system 74 include 1) its ability to change speed ratios and/or blade assembly diameters so as to permit the machine 20 to perform markedly different finishing operations and 2) its elimination of the need for a complex universal joint while still accommodating tilting movement of the driven shafts 202 of the gearboxes 52 relative to the engine output shaft 200. These two goals are achieved using 1) a variable speed ratio torque converter assembly 204 (FIG. 16), and 2) flexible drive shafts 206 (FIG. 17), respectively.

Figure 16:
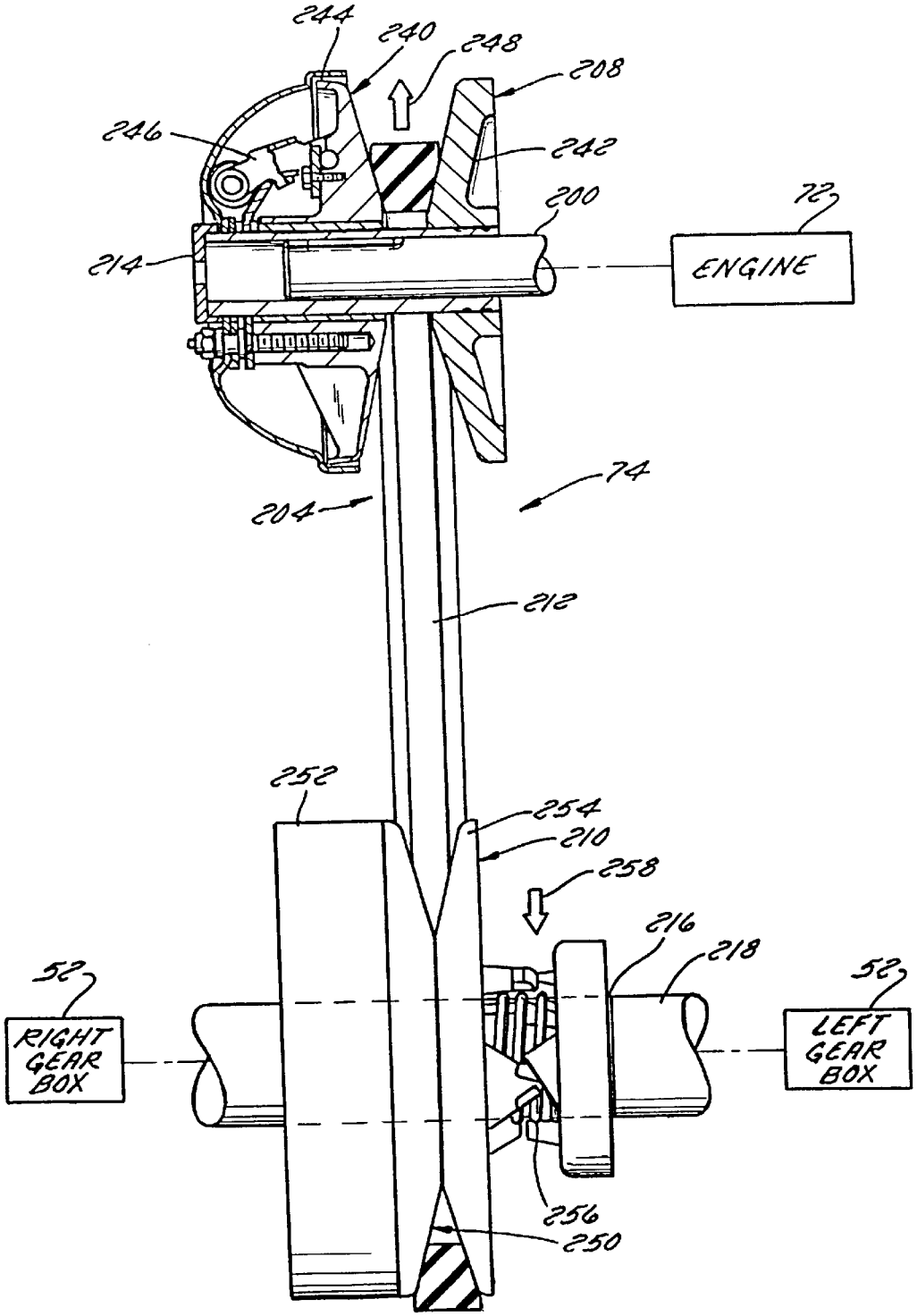
FIG. 16 is a partially fragmentary, partially schematic top plan view of the torque transfer system of FIGS. 14 and 15.

The torque converter assembly 204 includes variable speed drive and driven clutches 208 and 210 coupled to one another by a torque transfer element, preferably a belt 212. A hub 214 of the drive clutch 208 is keyed to the engine output shaft 200 (which may be either the actual output shaft of the engine 72 or another output shaft coupled directly or indirectly to the engine's output shaft) as illustrated in FIG. 16. Similarly, a hub 216 of the driven clutch 210 is keyed to a jackshaft 218 so that the jackshaft rotates with the driven clutch 210. The jackshaft 218 is supported on the frame 22 by pillow block bearings 220 and has output ends 222 that are coupled to the respective left and right flexible shafts 206.

Figure 17:
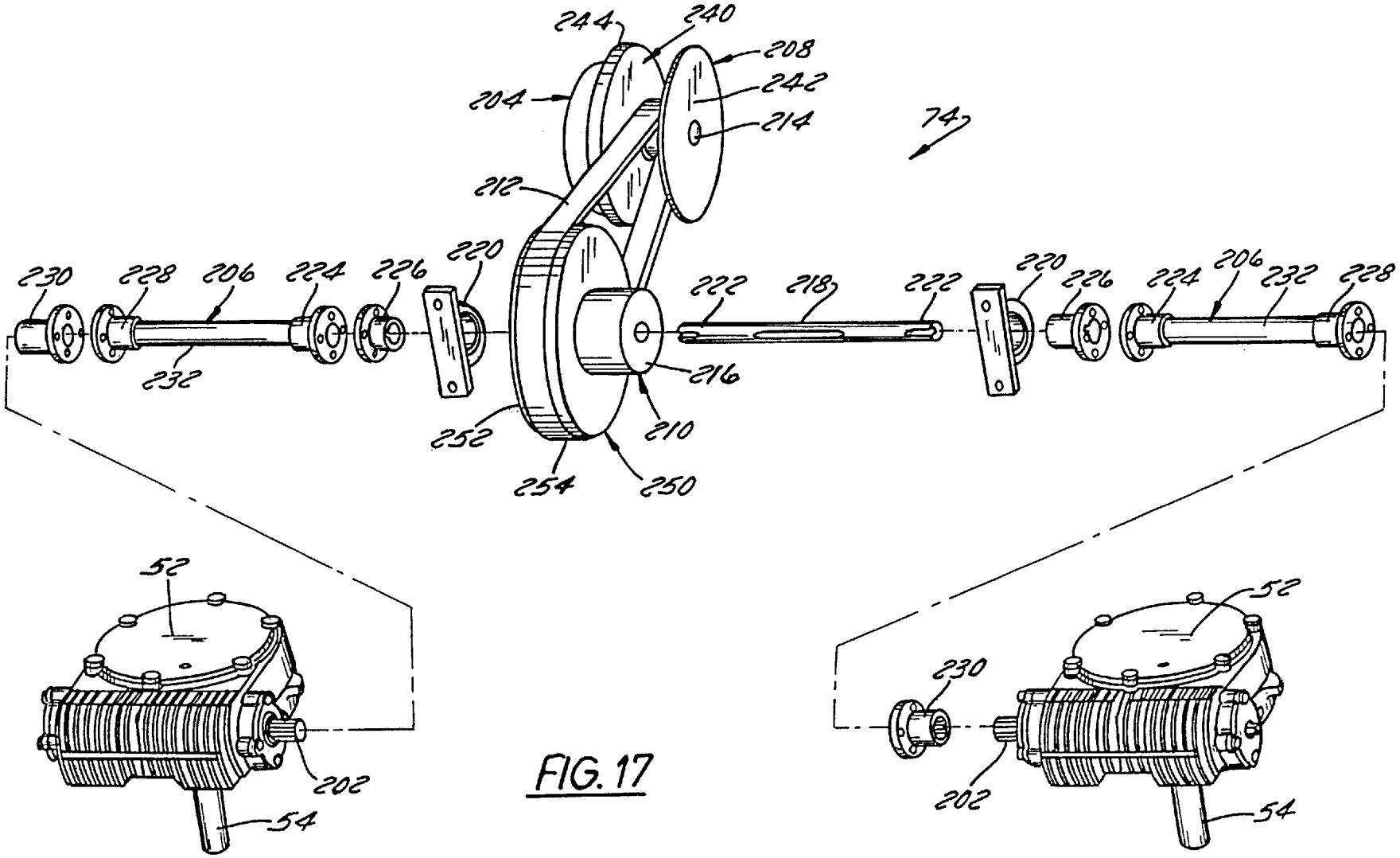
FIG. 17 is an exploded perspective view of the torque transfer system of FIGS. 14–16.

The flexible shafts 206 are coupled to both the jackshaft 218 and to the input shafts 202 of the gearboxes 52. Specifically, and as can be seen in FIG. 17, each of the flexible shafts 206 is fixed to an associated output end 222 of the jackshaft 218 via a coupling 226 pressed into the associated bearing 220. An input end of each coupling 226 is keyed to an associated output end 222 of the jackshaft 218, and an output end of each coupling 226 is bolted to a fitting 224 swagged onto the input end of the associated flexible shaft 206. Another fitting 228, swagged onto an output end of each of the flexible shafts 206, is coupled to the associated gearbox input shaft 202 by an internally splined coupling 230 bolted to the fitting 228. The splined fitting 230 permits relative axial movement between the flexible shaft 206 and the gearbox input shaft 202 during gearbox tilting. If desired, this relative movement could also be achieved by permitting axial movement between the flexible shaft 206 and the jackshaft 218.

As discussed briefly above, flexible shafts are used as the shafts 206 in order to accommodate tilting of the left and right gearboxes 52 relative to the jackshaft 218 without requiring complex universal joints. Each shaft 206 is formed from materials that permit it to bend along at least a substantial portion of the entire length thereof, typically all but at the ends and, while retaining sufficient torsional stiffness to permit the shaft 206 to drive the input shaft of the associated gearbox 52. The shafts 206 need not bend a great deal because the gearboxes 52 only tilt a few degrees (less than 10° and typically on the order of 4°) in operation. However, and unlike most applications in which flexible shafts of this type are used, the shafts 206 bend dynamically (i.e., while they are transmitting torque) and repeatedly during operation of the machine 20. A wound wire flexible shaft, often used in weed eaters and other equipment exhibiting a convoluted fixed path between the drive motor and the driven shaft, has been found to work well for this purpose. The illustrated shaft is in the range of 1' long and 1" in diameter. If desired, a sleeve 232, formed from rubber or some other moisture and dirt proof material, can be fitted around the wound wire of the shaft 206 to protect it. A suitable wound wire shaft is available, e.g., from Elliott Manufacturing Company of Binghamton, N.Y.

The torque converter assembly 204 is preferably of the variable speed ratio type available, e.g., from Comet Industries. As best seen in FIGS. 16 and 17, drive clutch 208 includes the aforementioned hub 214 and a variable width sheave 240. The sheave 240 includes a first portion 242 fixed to the hub 214 and a second portion 244 slidably mounted on the hub 214 so as to be axially movable towards and away from the first potion 242. The second portion 244 is biased away from the first portion 242 by a spring (not shown) and movable axially towards the first portion 242 under the action of a plurality of centrifugal cams 246. The inner axial faces of the first and second portions 242 and 244 are angled toward one another from the outer to inner radial ends thereof so that the effective radial diameter of the sheave 240 (corresponding to the location on the sheave 240 that is substantially the same width as the belt) varies inversely with the axial spacing between the first and second portions 242 and 244. Accordingly, as the speed of the engine output shaft 200 increases, the centrifugal cams 246 force the second portion 244 towards the first portion 242 to decrease the effective axial width of the sheave 240. The effective radial diameter of the sheave 240 therefore increases as the belt rides upwardly along the sheave in the direction of arrow 248 in FIG. 16.

The driven clutch 210 also has a variable diameter sheave 250, but the diameter of the sheave 250 varies inversely with the diameter of the sheave 240 of the drive clutch 208. Specifically, the sheave 250 of the driven clutch includes a first portion 252 fixed to the hub 216 and a second portion 254 mounted on the hub 216 so as to be axially movable towards and away from the first potion 252. The second portion 254 is biased towards the first portion 252 by a spring 256. As with the drive clutch, the inner axial faces of the first and second portions 252 and 254 are angled toward one another from the outer to inner radial ends thereof so that the effective radial diameter of the sheave 250 varies inversely with the axial spacing between the first and second portions 252 and 254. Accordingly, as the belt 212 moves outwardly along the sheave 240 of the drive clutch 208 during engine acceleration, the increased tension compresses the spring 256 to widen the axial gap between the first and second sheave portions 252 and 254 to reduce the effective diameter of the driven sheave 250. As a result, the belt 210 rides inwardly in the direction of arrow 258 in FIG. 16. The effective speed ratio of the torque converter assembly 204 therefore progressively increases upon engine acceleration, and progressively decreases upon engine deceleration as the reverse affect occurs. This permits the rotor assemblies 28 and 30 to be driven through a speed/torque range that varies dramatically with engine speed.

Figure 18:
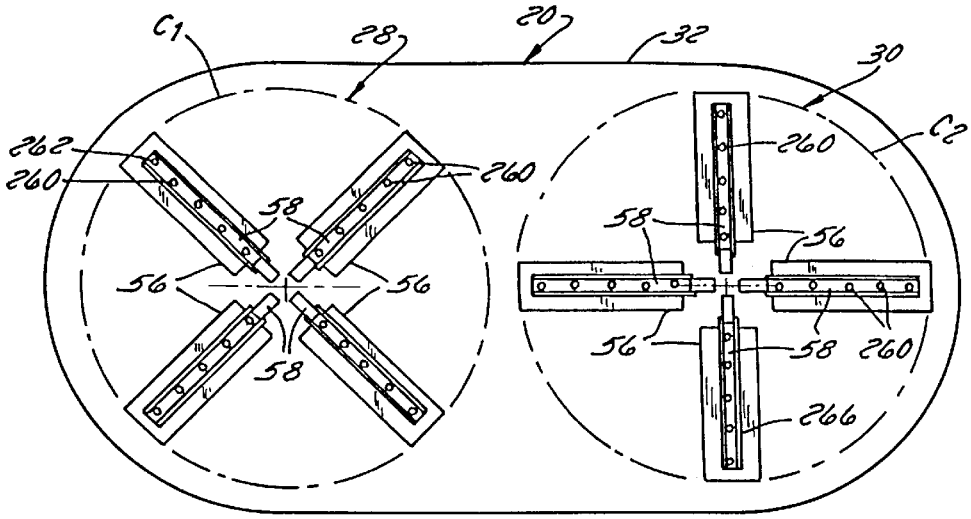
FIG. 18 is a bottom plan view of the finishing trowel with its blades configured for non-overlapping operation.
Figure 19:
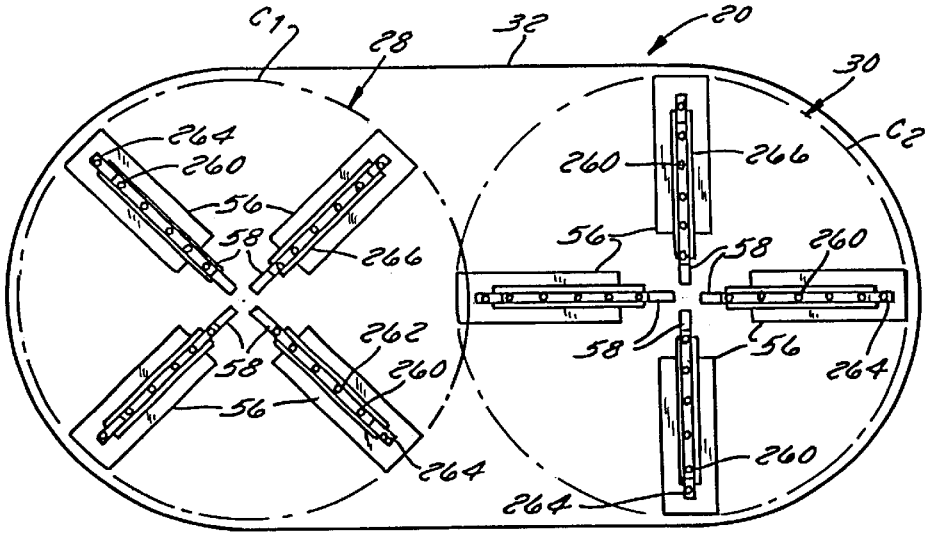
FIG. 19 is a bottom plan view of the finishing trowel with its blades configured for overlapping operation.
Figure 18A:
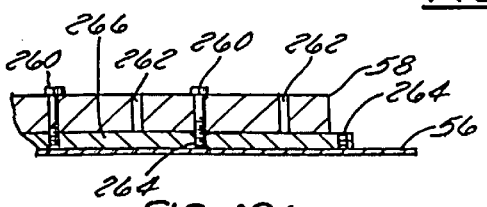
FIG. 18A is a fragmentary sectional elevation view of a portion of a rotor assembly of the finishing trowel configured as illustrated in FIG. 18.
Figure 19A:
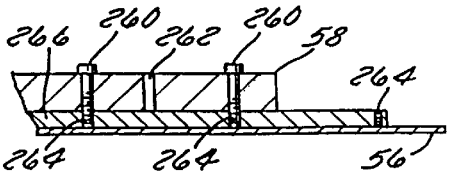
FIG. 19A is a fragmentary sectional elevation view of a portion of a rotor assembly of the finishing trowel configured as illustrated in FIG. 19.

The invention takes advantage of this capability by being capable of operating in both overlapping and non-overlapping modes using the same machine 20. Specifically, as best seen in FIGS. 18, 18A, 19, and 19A, the trowel blades 56 are mounted on their associated support arms 58 by bolts 260 that extend through bores 262 spaced axially along the support arms 58 and into tapped bores 264 in mounting brackets 266 for the blades 56. The support arms 58 are long enough and have enough mounting bores 262 to permit the blades 56 to be fixed to different points along the arms 58 so as to permit the trowel blades 56 to be mounted either 1) inwardly along the support arms 58 so that the two circles C1 and C2 circumscribing the blades 56 of the rotor assemblies 28 and 30 do not overlap, as seen in FIGS. 18, and 18A; or 2) outwardly along the support arms 58 so that the two circles C1 and C2 circumscribing the blades 56 of the rotor assemblies 28 and 30 overlap, as seen in FIGS. 19 and 19A. When the blades 56 are in their non-overlapping positions illustrated in FIGS. 18, and 18A, a circular pan (not shown) can be clipped onto the bottoms of the blades 56 of each of the rotor assemblies 28 and 30 to permit the machine 20 to perform a floating operation.

The finishing machine 20 can be used for virtually any finishing operation. For instance, to perform a so-called "floating" operation whose goal is to rough-finish freshly poured concrete as soon as the concrete sets enough to be finished, the blades 56 are mounted on the inner portions of the support arms 58 so that the circles C1 and C2 circumscribing each set of blades 56 do not overlap, as shown in FIGS. 18 and 18A, a pan (not shown) may then be clipped onto the blades 56 of each rotor assembly 28 or 30, and the finishing machine 20 is then steered over the concrete surface with the engine 72 being run at a low speed. At this time, the sheaves 240 and 250 of the drive and driven clutches 208 and 210 of the torque converter assembly 204 exhibit their minimum and maximum diameters, respectively (or diameters close to those minimum and maximum) to effect maximum speed change. As a result, high torque is transferred to the blades at low rpms—less than 50 rpm and typically on the order of 30 rpm. Alternatively, the blades 56 can be positioned further out along the support arms to a position in which the circles C1 and C2 overlap, as seen in FIGS. 19 and 19A. The operator can then steer the machine 20 over the concrete surface at different engine speeds and different blade pitches. The speed ratio of the torque converter assembly 204 increases as the engine speed increases, thereby permitting the rotor assemblies 28 and 30 to be driven at a higher speed than would otherwise be possible. The finishing machine 20 can even be used in so-called "burning operations," in which the blade pitch is maximized and the blades 56 are rotated at a high speed of more than 150 rpm and preferably on the order of about 200 rpm. Hence, a single concrete finishing machine 20 can be used for the entire finishing operation, including very low speed/high torque floating operations and very high speed burning operations, and the same blades 56 can be used for both non-overlapping and overlapping finishing operations. No previously-known machine has this degree of versatility.

The gearboxes 52 are tilted almost continuously during the finishing operations to effect the desired steering control. This tilting results in repeated, dynamic bending of the flexible shafts 206. It has been found that the shafts 206 require considerably less maintenance and have a much longer life than universal joints, while being impervious to damage from the wet concrete.

Many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims.

We claim:

1. A concrete finishing trowel comprising:

(A) a mobile frame;

(B) a rotor assembly which is supported on said mobile frame, said rotor assembly including a driven shaft and a plurality of trowel blades attached to and extending outwardly from said driven shaft so as to rest on a surface to be finished and to rotate with said driven shaft;

(C) a steering linkage which is operatively coupled to said rotor assembly so as to tilt at least a portion of said rotor assembly relative to said mobile frame upon movement of said steering linkage relative to said mobile frame;

(D) an electrically powered actuator which is coupled to said steering linkage and which is selectively electrically actuatable to translate said steering linkage so as to tilt said portion of said rotor assembly relative to said mobile frame; and (E) a manually-manipulated controller which is electronically coupled to said actuator, and which is selectively operable to generate electrical steering command signals used to energize said actuator so as to tilt said portion of rotor assembly relative to said mobile frame and to steer said finishing trowel.

2. A finishing trowel as defined in claim 1, wherein said rotor assembly further comprises a gearbox from which said driven shaft extends, and wherein said steering linkage includes a steering bracket which is coupled to said gearbox and to said actuator to tilt said gearbox relative to said mobile frame.

3. A finishing trowel as defined in claim 2, wherein said gearbox is tiltable both side-to-side and fore-and-aft to steer said finishing trowel forward/reverse and left/right, respectively, wherein said steering bracket comprises a steering frame fixed to said gearbox and having an input portion, wherein said actuator includes 1) a left right actuator which is coupled to said steering frame and which, when actuated by said controller, pivots said gearbox fore-and-aft so as to steer said finishing trowel left right, and 2) a forward reverse actuator which is coupled to said steering frame, which is coupled to said controller, and which, when actuated, pivots said gearbox side-to-side to steer said finishing trowel forward/reverse.

4. A finishing trowel as defined in claim 3, wherein said steering frame is mounted on said mobile frame via first and second bearing sets which permit said gearbox to pivot fore-and-aft and side-to-side, respectively, said first bearing set being mounted directly to said mobile frame, and said second bearing set being fixed to said steering frame and being mounted on said first bearing set via a cross tube.

5. A finishing trowel as defined in claim 4, wherein said steering frame has first and second opposed ends extending across said gearbox, wherein said left/right actuator is pivotably coupled to said first end of said steering frame, and further comprising a pitch adjustment post mount which is located at said second end of said steering frame and which supports a post of a blade pitch adjustment assembly, said blade pitch adjustment assembly being operable to alter a pitch of said blades to switch from one finishing mode to another.

6. A finishing trowel as defined in claim 2, wherein said finishing trowel is a riding trowel of which said rotor assembly and said steering linkage are a first rotor assembly and a first steering linkage, respectively, and further comprising (A) a second rotor assembly which is spaced from said first rotor assembly and which includes a second gearbox which is supported on said mobile frame, a second driven shaft, and a plurality of trowel blades attached to and extending outwardly from said second driven shaft so as to rest on the surface to be finished and to rotate with said second driven shaft; and (B) a second steering linkage including (1) a second steering bracket which is coupled to said second gearbox so as to tilt said second gearbox relative to said mobile frame upon movement of said second steering bracket relative to said mobile frame, and (2) a second electrically powered actuator which is coupled to said second steering bracket and which is selectively electrically actuatable to translate said second steering bracket so as to tilt said second gearbox relative to said mobile frame.

7. A finishing trowel as defined in claim 6, wherein said controller is electronically coupled to said second actuator of said second steering linkage and is selectively operable to generate steering command signals used to energize said second actuator so as to tilt said second gearbox relative to said mobile frame and to steer said finishing trowel.

8. A finishing trowel as defined in claim 7, wherein said controller comprises a single two axis joystick coupled to the actuators of both of said steering linkages.

9. A finishing trowel as defined in claim 7, wherein said controller comprises 1) a first joystick which is electrically coupled to only said first actuator, and 2) a second joystick which is electrically coupled to only said second actuator.

10. A finishing trowel as defined in claim 9, wherein said first joystick comprises a dual-axis joystick and said second joystick comprises a single-axis joystick.

11. A finishing trowel as defined in claim 6, wherein said second gearbox is mounted on said mobile frame via 1) a bearing set which is mounted on said mobile frame, and 2) a steering frame which is mounted on said bearing set and which is connected to said second gearbox to permit said second gearbox to tilt side-to-side during a forward/reverse steering operation.

12. A finishing trowel as defined in claim 1, wherein said controller is a joystick movable at least one of side-to-side and fore-and-aft.

13. A finishing trowel as defined in claim 12, wherein said joystick includes a switch which, when activated, causes said finishing trowel to turn.

14. A finishing trowel as defined in claim 12, wherein said joystick is a proportional control joystick which transmits a control signal to said actuator which causes said actuator to translate at least a portion of said steering linkage proportionally to a magnitude of joystick displacement.

15. A finishing trowel as defined in claim 1, further comprising a lift cage which extends upwardly from said frame and via which said finishing trowel can be lifted for transport.

16. A riding concrete finishing trowel comprising:

(A) a mobile frame having an upper deck:

(B) an operator's platform mounted on said deck;

(C) a plurality of rotor assemblies, each of which includes a gearbox which is supported on said mobile frame, a driven shaft, and a plurality of trowel blades attached to and extending outwardly from said driven shaft so as to rest on a surface to be finished and to rotate with said driven shaft;

(D) a plurality of steering assemblies, one of which is coupled to each of said gearboxes, each of said steering assemblies including (1) a steering linkage which is coupled to the associated gearbox so as to tilt the associated gearbox relative to said mobile frame upon movement of said steering linkage relative to said mobile frame, and (2) an electrically powered actuator which is coupled to said steering linkage and which is selectively electrically energizable to translate said steering linkage so as to tilt the associated gearbox relative to said mobile frame; and (E) a manually-manipulated controller which is located in the vicinity of said operator's platform, which is electronically coupled to the actuators of said steering assemblies, and which is selectively operable to generate steering command signals used to energize said actuators so as to tilt said gearboxes relative to said mobile frame and to steer said finishing trowel.

17. A riding concrete finishing trowel comprising:

(A) a mobile frame having an upper deck;

(B) an operator's platform mounted on an at least generally central portion of said deck;

(C) a left rotor assembly comprising (1) a left gearbox which is supported on said mobile frame on one side of said operator's platform, and (2) a left blade assembly which extends downwardly from said left gearbox and which includes a driven shaft and a plurality of trowel blades attached to and extending outwardly from said driven shaft so as to rest on a surface to be finished and to rotate with said driven shaft;

(D) a right rotor assembly comprising (1) a right gearbox which is supported on said mobile frame on another side of said operator's platform, and (2) a right blade assembly which extends downwardly from said right gearbox and which includes a driven shaft and a plurality of trowel blades attached to and extending outwardly from said driven shaft so as to rest on the surface to be finished and to rotate with said driven shaft;

(E) left and right steering assemblies, each of which is coupled to a corresponding one of said left and right gearboxes, each of said steering assemblies including (1) a steering linkage which is coupled to the associated gearbox so as to tilt the associated gearbox relative to said mobile frame upon movement of said steering linkage relative to said mobile frame, and (2) at least one electric ball screw actuator which is coupled to said steering linkage and which is selectively actuatable to translate said steering linkage to tilt the associated gearbox relative to said mobile frame; and (F) a manually-manipulated controller which is located in the vicinity of said operator's platform, which is electronically coupled to all of said actuators, and which is selectively operable to energize said actuators so as to tilt said gearboxes relative to said mobile frame and to steer said finishing trowel.

18. The finishing trowel as defined in claim 17, wherein one of said gearboxes is tiltable about two axes so as to be capable of steering said finishing trowel both forward/reverse and left/right and the other of said gearboxes is tiltable about only one axis so as to be capable of steering said finishing trowel only forward/reverse.

19. A riding concrete finishing trowel comprising:

(A) a mobile frame having an upper deck;

(B) an engine mounted on said frame;

(C) an operator's platform mounted on an at least generally central portion of said deck;

(D) a right rotor assembly, (1) a right gearbox which a) is driven by said engine and b) is supported on said mobile frame on one side of said operator's platform so as to be tiltable about both a first longitudinal axis and a lateral axis, and (2) a right blade assembly which extends downwardly from said right gearbox and which includes a driven shaft and a plurality of trowel blades attached to and extending outwardly from said driven shaft so as to rest on a surface to be finished and to rotate with said driven shaft;

(E) a left rotor assembly, (1) a left gearbox which a) is driven by said engine and b) is supported on said mobile frame on another side of said operator's platform so as to be tiltable about only a second longitudinal axis, and (2) a left blade assembly which extends downwardly from said left gearbox and which includes a driven shaft and a plurality of trowel blades attached to and extending outwardly from said driven shaft so as to rest on the surface to be finished and to rotate with said driven shaft;

(F) a right steering assembly which is coupled to said right gearbox and which includes (1) a right steering frame which is coupled to said right gearbox so as to a) tilt said right gearbox about said first longitudinal axis upon pivotal movement of said right steering frame relative to said mobile frame in a first direction, and b) tilt said right gearbox about said lateral axis upon movement of said right steering frame relative to said mobile frame in a second direction, (2) a first forward/reverse ball screw electric actuator which is coupled to said right steering frame and which is selectively actuatable to pivot said right steering frame in said first direction, and (3)a left/right electric ball screw actuator which is coupled to said right steering frame and which is selectively actuatable to pivot said right steering frame in said second direction;

(G) a left steering assembly which includes (1) a left steering frame which is coupled to said left gearbox so as to tilt said left gearbox about said second longitudinal axis upon movement of said left steering frame relative to said mobile frame, and (2) a second forward/reverse electric ball screw actuator which is coupled to said left steering frame and which is selectively actuatable to translate said left steering frame so as to tilt said left gearbox about said second longitudinal axis; and (H) a manually-manipulated controller which is located in the vicinity of said operator's platform, which is electronically coupled to all of said actuators, and which is selectively operable to energize said actuators so as to tilt said gearboxes relative to said mobile frame and to steer said finishing trowel, said controller comprising at least one dual axis proportional control joystick.

20. A riding concrete finishing trowel comprising:

(A) a mobile frame;

(B) a rotor assembly which is mounted on said mobile frame, said rotor assembly including a driven shaft and a plurality of trowel blades attached to and extending outwardly from said driven shaft so as to rest on a surface to be finished and to rotate with said driven shaft;

(C) a controller which is manually actuatable to generate an electronic steering command signal; and (D) at least one electrically powered actuator which receives said steering command signal from said controller and which is electrically energizable, in response to the receipt of said steering command signal from said controller, to tilt said driven shaft so as to steer said riding trowel.

21. A riding trowel as defined in claim 20, wherein said controller comprises at least one joystick.

22. A riding trowel as defined in claim 21, wherein said joystick is a proportional control joystick.

23. A method of steering a riding concrete finishing trowel, said finishing trowel having a mobile frame, an operator's platform mounted on said frame, and at least one rotor assembly including 1) a driven shaft extending downwardly from said frame, and 2) a plurality of trowel blades attached to and extending outwardly from said driven shaft so as to rest on a surface to be finished and to rotate with said driven shaft, said method comprising;

(A) actuating a controller to generate an electronic signal indicative of a desired steering command;

(B) transmitting said signal from said controller to an electrically powered actuator; and (C) in response to receipt of said signal, electrically energizing said actuator to tilt said driven shaft so as to steer said finishing trowel.

24. A method as defined in claim 23, wherein said actuating step comprises moving a joystick about at least one axis.

25. A method as defined in claim 24, wherein a magnitude of said signal and magnitudes of actuator energization and driven shaft tilting are proportional to a magnitude of joystick movement.

26. A method as defined in claim 23, wherein said driven shaft is tiltable about first and second mutually perpendicular axes to effect both forward/reverse and left/right steering control, wherein said actuator includes 1) a left/right actuator which is coupled to said driven shaft so as tilt said driven shaft about said first axis so as to effect left/right steering control, and 2) a forward reverse actuator which is coupled to said controller so as to selectively drive said driven shaft to tilt about said second axis so as to effect forward/reverse steering control, and wherein said actuating step further comprises actuating said controller in a first manner to transmit a signal to said left right actuator and in a second manner to transmit a signal to said forward reverse actuator.

27. A method as defined in claim 26, wherein said actuator is a dual-axis joystick, and wherein said step of actuating said controller in said first manner comprises moving said joystick side-to-side and said step of actuating said controller in said second manner comprises moving said joystick fore-and-aft.

28. A method as defined in claim 27, further comprising actuating a rocker switch on said joystick to simultaneously transmit signals to two actuators of said actuator to cause said finishing trowel to turn.

29. A method as defined in claim 23, wherein said finishing trowel has left and right rotor assemblies each having a tiltable driven shaft and an actuator, and wherein said transmitting step comprises transmitting said signal from said controller to the actuators of both of said rotor assemblies.

30. A method as defined in claim 29, wherein the actuator of one of said left and right rotor assemblies includes both a forward/reverse actuator and a left right actuator only a forward/reverse actuator, and wherein said transmitting step comprises 1) transmitting a forward reverse steering command signal to the forward/reverse actuators of both of said left and right rotor assemblies, and 2) transmitting a left right steering command signal to only the left right actuator.

31. A method as defined in claim 30, wherein said actuating step comprises moving a single joystick both fore-and-aft and side-to-side to generate both a forward/reverse steering command signal and a left/right steering command signal.

32. A method as defined in claim 30, wherein said actuating step comprises moving either of first and second joysticks fore-and-aft to generate a forward/reverse steering command signal and moving only said first joystick side-to-side to generate a left/right steering command signal, movement of said second joystick being incapable of generating said left/right steering command signal.

33. A finishing trowel as defined in claim 1, wherein the electric actuator comprises an electric ball screw actuator.

34. A finishing trowel as defined in claim 1, wherein said actuator comprises an electric motor and a translatable output which is driven by said motor and which is mechanically coupled to the said steering linkage.

35. A finishing trowel as defined in claim 16, wherein said actuator comprises an electric motor and a translatable output which is driven by said motor and which is mechanically coupled to the said steering linkage.

36. A riding trowel as defined in claim 20, wherein said actuator comprises an electric motor and a translatable output which is driven by said motor and which is mechanically coupled to the said steering linkage, and wherein said actuator is selectively actuatable to translate said steering linkage so as to tilt said driven shaft so as to steer said riding trowel.

37. A riding concrete finishing trowel comprising:

(A) a mobile frame having an upper deck;

(B) an operator's platform mounted on an at least generally central portion of said deck;

(C) a left rotor assembly comprising:

(1) a left gearbox which is supported on said mobile frame on one side of said operator's platform, and (2) a left blade assembly which extends downwardly from said left gearbox and which includes a driven shaft and a plurality of trowel blades attached to and extending outwardly from said driven shaft so as to rest on a surface to be finished and to rotate with said driven shaft;

(D) a right rotor assembly comprising;

(1) a right gearbox which is supported on said mobile frame on another side of said operator's platform, and (2) a right blade assembly which extends downwardly from said right gearbox and which includes a driven shaft and a plurality of trowel blades attached to an extending outwardly from said driven shaft so as to rest on the surface to be finished and to rotate with said driven shaft;

(E) left and right steering assemblies, each of which is coupled to a corresponding one of said left and right gearboxes, each of said steering assemblies including (1) a steering linkage which is coupled to the associated gearbox so as to tilt the associated gearbox relative to said mobile frame upon movement of said steering linkage relative to said mobile frame, and (2) at least one electrically powered actuator which is coupled to said steering linkage and which is selectively electrically actuatable to translate said steering linkage to tilt the associated gearbox relative to said mobile frame; and (F) a manually-manipulated controller which is located in the vicinity of said operator's platform, which is electronically coupled to all of said actuators, and which is selectively operable to energize said actuators so as to tilt said gearboxes relative to said mobile frame and to steer said finishing trowel.

38. A riding concrete finishing trowel comprising:

(A) a mobile frame having an upper deck;

(B) an engine mounted on said frame;

(C) an operator's platform mounted on an at least generally central portion of said deck;

(D) a right rotor assembly, (1) a right gearbox which a) is driven by said engine and b) is supported on said mobile frame on one side of said operator's platform so as to be tiltable about both a first longitudinal axis and a lateral axis, and (2) a right blade assembly which extends downwardly from said right gearbox and which includes a driven shaft and a plurality of trowel blades attached to and extending outwardly from said driven shaft so as to rest on a surface to be finished and to rotate with said driven shaft;

(E) a left rotor assembly, (1) a left gearbox which a) is driven by said engine and b) is supported on said mobile frame on another side of said operator's platform so as to be tiltable about only a second longitudinal axis, and (2) a left blade assembly which extends downwardly from said left gearbox and which includes a driven shaft and a plurality of trowel blades attached to and extending outwardly from said driven shaft so as to rest on the surface to be finished and to rotate with said driven shaft;

(F) a right steering assembly which is coupled to said right gearbox and which includes (1) a right steering frame which is coupled to said right gearbox so as to a) tilt said right gearbox about said first longitudinal axis upon pivotal movement of said right steering frame relative to said mobile frame in a first direction, and b) tilt said right gearbox about said lateral axis upon movement of said right steering frame relative to said mobile frame in a second direction, (2) a first forward/reverse electrically powered actuator which is coupled to said right steering frame and which is selectively electrically actuatable to pivot said right steering frame in said first direction, and (3) a left/right electrically powered actuator which is coupled to said right steering frame and which is selectively electrically actuatable to pivot said right steering frame in said second direction;

(G) a left steering assembly which includes (1) a left steering frame which is coupled to said left gearbox so as to tilt said left gearbox about said second longitudinal axis upon movement of said left steering frame relative to said mobile frame, and (2) a second forward/reverse electrically powered actuator which is coupled to said left steering frame and which is selectively electrically actuatable to translate said left steering frame so as to tilt said left gearbox about said second longitudinal axis; and (H) a manually-manipulated controller which is located in the vicinity of said operator's platform, which is electronically coupled to all of said actuators, and which is selectively operable to energize said actuators so as to tilt said gearboxes relative to said mobile frame and to steer said finishing trowel, said controller comprising at least one dual axis proportional control joystick.

39. A riding concrete finishing trowel comprising:

(A) a mobile frame having an upper deck;

(B) an operator's platform mounted on an at least generally central portion of said deck;

(C) a left rotor assembly comprising:

(1) a left gearbox which is supported on said mobile frame on one side of said operator's platform, and (2) a left blade assembly which extends downwardly from said left gearbox and which includes a driven shaft and a plurality of trowel blades attached to and extending outwardly from said driven shaft so as to rest on a surface to be finished and to rotate with said driven shaft;

(D) a right rotor assembly comprising;

(1) a right gearbox which is supported on said mobile frame on another side of said operator's platform, and (2) a right blade assembly which extends downwardly from said right gearbox and which includes a driven shaft and a plurality of trowel blades attached to an extending outwardly from said driven shaft so as to rest on the surface to be finished and to rotate with said driven shaft;

(E) left and right steering assemblies, each of which is coupled to a corresponding one of said left and right gearboxes, each of said steering assemblies including (1) a steering linkage which is coupled to the associated gearbox so as to tilt the associated gearbox relative to said mobile frame upon movement of said steering linkage relative to said mobile frame, and (2) at least one electrically powered actuator which is coupled to said steering linkage and which is selectively electrically energizable to translate said steering linkage to tilt the associated gearbox relative to said mobile frame;

(F) a manually-manipulated controller which is located in the vicinity of said operator's platform, which is electronically coupled to all of said actuators, and which is selectively operable to generate electrical steering command signals used to energize said actuators; and (G) a single internal combustion engine that generates sufficient power to operate all powered components of said concrete finishing machine, said engine having a maximum power output of no more than about 25.

40. A concrete finishing machine as recited in claim 1, further comprising a single internal combustion engine that generates sufficient power to operate to all powered components of said concrete finishing machine, said engine having a maximum power output of no more than about 25.

41. A concrete finishing machine as recited in claim 20, further comprising a single internal combustion engine that generates sufficient power to operate to all powered components of said concrete finishing machine, said engine having a maximum power output of no more than about 25.

42. A method as recited in claim 23, further comprising generating all power required to operate to all powered components of said concrete finishing machine using a single internal combustion engine, said engine having a maximum power output of no more than about 25.

43. A finishing trowel as defined in claim 3, wherein said left/right actuator includes a linearly-movable driven rod that is aligned with said steering frame such that forces generated by linear movement of said driven rod are transmitted linearly to said steering frame to drive said steering frame to pivot fore-and-aft.

44. A method as defined in claim 26, wherein said driven shaft is mounted on a steering box that is mounted on a steering bracket, wherein said steering box is supported on said frame for fore-and-aft and side-to-side pivoting movement with respect thereto, wherein said left/right actuator includes a linearly-movable driven rod that is aligned with said steering frame, and wherein forces generated by linear movement of said driven rod are transmitted linearly to said steering frame to drive said steering frame to pivot fore-and-aft relative to said frame.

* * * * *